US005894735A

United States Patent [19]

Misawa et al.

[11] Patent Number: 5,894,735

[45] Date of Patent: Apr. 20, 1999

[54] HEAT PUMP SYSTEM USING ENERGY-SUPPLYING MECHANISM TO CONTROL REFRIGERANT PRESSURE

[75] Inventors: Makoto Misawa; Hideyuki Ohashi; Manabu Ito, all of Shingai Iwata Shizuoka, Japan

[73] Assignee: Yamaha Hatsudoki Kabushiki Kaisha, Shizuoka-ken, Japan

[21] Appl. No.: 08/708,685

[22] Filed: Sep. 5, 1996

[51] Int. Cl.[6] ..... F25D 17/00; F25B 27/00

[52] U.S. Cl. ..... 62/177; 62/DIG. 17; 62/238.6; 165/240

[58] Field of Search ..... 62/DIG. 17, 238.6, 62/238.7, 177, DIG. 2; 165/240

[56] References Cited

U.S. PATENT DOCUMENTS 4,785,639 11/1988 Biagini ..... 62/DIG. 17
5,632,442 5/1997 Misawa et al. ..... 165/240 X

FOREIGN PATENT DOCUMENTS 405071834 3/1993 Japan ..... 62/DIG. 2
7-234037 9/1995 Japan .

*Primary Examiner*—William Wayner
*Attorney, Agent, or Firm*—Knobbe, Martens, Olson & Bear, LLP

[57] ABSTRACT

A heat pump system usable as an air-conditioning apparatus, a refrigeration apparatus, or a temperature-conditioning apparatus, having stable cooling, heating, or freezing capacity without significant influence from the difference in height between the expansion valve and the compressor, and the length of piping of the refrigerant circulation line, which system comprises a pressure sensing means for measuring the pressure in the refrigerant line immediately upstream of the expansion valve; optionally a pressure sensing means for measuring the pressure in the refrigerant line immediately downstream of the compressor; and an energy-supplying mechanism for exerting energy onto the refrigerant when the measured pressure is lower than a predetermined value, thereby controlling the pressure in the high pressure refrigerant line.

6 Claims, 17 Drawing Sheets

HEAT PUMP SYSTEM USING ENERGY-SUPPLYING MECHANISM TO CONTROL REFRIGERANT PRESSURE

BACKGROUND

1. Field of the Invention

This invention relates to a heat pump system usable as an air-conditioning apparatus, a refrigeration apparatus, or a temperature-conditioning apparatus, and in particular, to such an apparatus provided with a refrigerant flow control system which allows for stable heat pumping operation by compensating for pressure decrease in the high pressure refrigerant line due to, for example, head difference and pressure loss in piping between the compressor and the expansion valve, accompanied by pressure loss due to excessive radiation heat in the piping.

2. Background of the Art

A heat pump system, which is used as an air-conditioning apparatus or a refrigeration apparatus, enables cooling or heating the air in a room or a refrigerator by circulating refrigerant in a refrigerant circulation line through an outside heat-exchanger (condenser), an expansion valve, an inside heat-exchanger (evaporator), and an accumulator in sequence, with a compressor driven by an engine or an electric motor, for example.

When an outside unit including an outside-heat exchanger (condenser) and a compressor is placed on the ground while an inside unit including an inside heat-exchanger (evaporator) is placed on a higher level such as on the third or fourth floor, and an expansion valve is also located on a higher level, pressure loss in piping increases. Pressure loss in piping can occur for various reasons, e.g., flow resistance and a pressure decrease due to excessive radiation heat. In such cases, cooling or heating operation is conducted with significant pressure loss.

In addition, in a freezing system, when an outside unit including a condenser (an outside heat-exchanger) and a compressor is placed on the ground while an inside unit including an inside heat-exchanger (evaporator) is placed on a higher level such as on the second or third floor, and an expansion valve is also located on a higher level, pressure loss in piping increases. Pressure loss in piping can occur for other reasons, e.g., due to excessive radiation heat in piping. In such cases, freezing operation is conducted with significant pressure loss.

As understood from the above, when a heat pump system is operated as an air-conditioning apparatus to cool or heat the air in a room or as a refrigeration apparatus to cool the air in a storage compartment of a refrigeration apparatus, wherein there is a great head difference between the compressor and the expansion valve, the pressure in the high pressure refrigerant line in the vicinity of and upstream of the expansion valve decreases. Also, when the length of pipes used in the high pressure refrigerant line from the compressor to the expansion valve in these systems is long, the pressure in the high pressure refrigerant line in the vicinity of and upstream of the expansion valve decreases. Further, when the refrigerant loses too much heat, radiation heat, in the lengthy piping on the high pressure side, the pressure in the vicinity of and upstream of the expansion valve also decreases. In addition, when the length of pipes used in the low pressure refrigerant line from the expansion valve to the compressor in these systems is long, the intake pressure of the compressor decreases. When the intake pressure decreases, the discharge pressure also decreases, and the volume of the discharge refrigerant decreases. The volume of the refrigerant passing through the condenser decreases, and thus, the radiation area per refrigerant weight/time increases, i.e., more liquid refrigerant condenses, thereby reducing the pressure upstream of the expansion valve. Thus, the discharge pressure decrease in addition to the pressure decrease due to the increased condensation efficiency leads to a decrease in the pressure in the high pressure refrigerant line in the vicinity of and upstream of the expansion valve.

As described above, when the pressure in the high pressure refrigerant in the vicinity of and upstream of the expansion valve decreases, the difference between the high pressure upstream of the expansion valve and the low pressure downstream of the expansion valve becomes small, resulting in decrease in the amount of the refrigerant passing through the expansion valve. As a result, the cooling, heating, or freezing capacity is reduced.

SUMMARY OF THE INVENTION

The present invention has exploited a heat pump system usable as an air-conditioning apparatus or a refrigeration apparatus having stable cooling, heating, or freezing capacity without significant influence from the installation site, e.g., the difference in height between the expansion valve and the compressor, and the length of piping of the refrigerant circulation line. An objective of the present invention is to provide a heat pump system which allows for stable heat pumping operation even when head difference and/or pressure loss in piping between the compressor and the expansion valve are/is significant.

Namely, one important aspect of the present invention is a heat pump system comprising a refrigerant circulation line in which a refrigerant circulates, said refrigerant circulation line comprising: a compressor for circulating said refrigerant; a condenser for exchanging heat between said refrigerant and the medium (such as air) outside said condenser; an expansion valve; and an evaporator for exchanging heat between said refrigerant and the medium (such as air) outside said evaporator, wherein the refrigerant circulation line downstream of said compressor and upstream of said expansion valve constitutes a high pressure refrigerant line, and the refrigerant circulation line downstream of said expansion valve and upstream of said compressor constitutes a low pressure refrigerant line, said system further comprising: a high pressure sensing means for measuring the pressure in the high pressure refrigerant line, said high pressure sensing means being provided at a location closer to said expansion valve than to said compressor; and an energy-supplying mechanism for exerting energy onto the refrigerant when the measured pressure is lower than a predetermined level. By directly measuring the pressure decrease in the high pressure refrigerant line near the expansion valve due to head difference between the compressor and the expansion valve and/or pressure loss in piping, and accordingly by exerting energy onto the refrigerant when the pressure decrease occurs, it is possible to increase the pressure in the vicinity of the expansion valve in the high pressure refrigerant line, thereby preventing a decrease in the amount of refrigerant flowing through the expansion valve, i.e., stable cooling, freezing, or heating operation is achieved.

Another important aspect of the present invention is a heat pump system comprising a refrigerant circulation line in which a refrigerant circulates, said refrigerant circulation line comprising: a compressor for circulating said refrigerant; a condenser for exchanging heat between said refrigerant and the medium (such as air) outside said condenser; an expansion valve; and an evaporator for exchanging heat between said refrigerant and the medium (such as air) outside said evaporator, wherein the refrigerant circulation line downstream of said compressor and upstream of said expansion valve constitutes a high pressure refrigerant line, and the refrigerant circulation line downstream of said expansion valve and upstream of said compressor constitutes a low pressure refrigerant line, said system further comprising: a high pressure sensing means for measuring the pressure in the high pressure refrigerant line, said high pressure sensing means being provided at a location closer to said expansion valve than to said compressor; a low pressure sensing means for measuring the pressure in the low pressure refrigerant line; and an energy-supplying mechanism for exerting energy onto the refrigerant when the difference between the pressure measured by said high pressure sensing means and that measured by said low pressure sensing means is smaller than a predetermined value. By directly measuring the pressure decrease in the high pressure refrigerant line near the expansion valve due to head difference between the compressor and the expansion valve and/or pressure loss in piping, accordingly by exerting energy onto the refrigerant when the difference between the pressure measured by the high pressure sensing means and that measured by the low pressure sensing means is smaller than a predetermined pressure, it is possible to increase the pressure in the vicinity of the expansion valve in the high pressure refrigerant line, thereby preventing a decrease in the refrigerant amount flowing through the expansion valve, i.e., stable cooling, freezing, or heating operation is achieved.

Still another important aspect of the present invention is a heat pump system comprising a refrigerant circulation line in which a refrigerant circulates, said refrigerant circulation line comprising: a compressor for circulating said refrigerant; a condenser for exchanging heat between said refrigerant and the medium (such as air) outside said condenser; an expansion valve; and an evaporator for exchanging heat between said refrigerant and the medium (such as air) outside said evaporator, wherein the refrigerant circulation line downstream of said compressor and upstream of said expansion valve constitutes a high pressure refrigerant line, and the refrigerant circulation line downstream of said expansion valve and upstream of said compressor constitutes a low pressure refrigerant line, said system further comprising: first and second high pressure sensing means for measuring the pressure in the high pressure refrigerant line, said first high pressure sensing means being provided at a location closer to said compressor than to said expansion valve, and said second high pressure sensing means being provided at a location closer to said expansion valve than to said compressor; and an energy-supplying mechanism for exerting energy onto the refrigerant when the difference between the pressure measured by said first high pressure sensing means and that measured by said second high pressure sensing means is greater than a predetermined level. By directly measuring pressure loss in piping in the high pressure refrigerant line from the compressor to the expansion valve as well as the pressure decrease due to the head difference between the compressor and the expansion valve, accordingly by exerting energy onto the refrigerant when the difference between the pressures measured by the first and the second high pressure sensing means is greater than a predetermined value, it is possible to increase the pressure in the vicinity of the expansion valve in the high pressure refrigerant line, thereby preventing a decrease in the refrigerant amount flowing through the expansion valve, i.e., stable cooling, freezing, or heating operation is achieved.

Yet another important aspect of the present invention is a heat pump system comprising a refrigerant circulation line in which a refrigerant circulates, said refrigerant circulation line comprising: a compressor for circulating said refrigerant; a condenser for exchanging heat between said refrigerant and the medium (such as air) outside said condenser; an expansion valve; and an evaporator for exchanging heat between said refrigerant and the medium (such as air) outside said evaporator, wherein the refrigerant circulation line downstream of said compressor and upstream of said expansion valve constitutes a high pressure refrigerant line, and the refrigerant circulation line downstream of said expansion valve and upstream of said compressor constitutes a low pressure refrigerant line, said system further comprising: first and second low pressure sensing means for measuring the pressure in the low pressure refrigerant line, said first low pressure sensing means being provided at a location closer to said expansion valve than to said compressor, and said second low pressure sensing means being provided at a location closer to said compressor than to said expansion valve; and an energy-supplying mechanism for exerting energy onto the refrigerant when the difference between the pressure measured by said first low pressure sensing means and that measured by said second low pressure sensing means is greater than a predetermined value. When the pressure loss in the low pressure refrigerant line from the expansion valve to the compressor is high, the intake pressure of the compressor is decreased, and accordingly the amount of the refrigerant discharging from the compressor is reduced, thereby reducing the discharge pressure of the compressor. When the amount of the refrigerant discharging from the compressor is reduced, the amount of the refrigerant passing through the condenser is reduced, thereby increasing the radiation area per refrigerant weight/time. As a result, the refrigerant passing through the condenser is condensed to a higher degree, resulting in reduction in pressure. Thus, the pressure in the high pressure refrigerant line is reduced due to the above discharge pressure reduction and the above pressure reduction. Even under the above circumstances, according to the present invention, the pressure in the high pressure refrigerant line can be adjusted appropriately. By measuring the difference between the pressures measured by the first and second low pressure sensing means, it is possible to indirectly measure the pressure decrease in the high pressure refrigerant line. In this way, it is possible to increase the pressure in the vicinity of the expansion valve in the high pressure refrigerant line, thereby preventing a decrease in the amount of refrigerant flowing through the expansion valve, i.e., stable cooling, freezing, or heating operation is achieved.

A further important aspect of the present invention is a heat pump system comprising a refrigerant circulation line in which a refrigerant circulates, said refrigerant circulation line comprising: a compressor for circulating said refrigerant; a condenser for exchanging heat between said refrigerant and the medium (such as air) outside said condenser; an expansion valve; and an evaporator for exchanging heat between said refrigerant and the medium (such as air) outside said evaporator, wherein the refrigerant circulation line downstream of said compressor and upstream of said expansion valve constitutes a high pressure refrigerant line, and the refrigerant circulation line downstream of said expansion valve and upstream of said compressor constitutes a low pressure refrigerant line, said system further comprising: a head difference measuring means for measuring the head difference between said compressor and said expansion valve; and an energy-supplying mechanism for exerting energy onto the refrigerant when the head difference is greater than a predetermined value. According to this aspect, the pressure decrease in the vicinity of the expansion valve in the high pressure refrigerant line due to the head difference occurring between the compressor and the expansion valve can efficiently be compensated for.

Still another important aspect of the present invention is a heat pump system comprising a refrigerant circulation line in which a refrigerant circulates, said refrigerant circulation line comprising: a compressor for circulating said refrigerant; a condenser for exchanging heat between said refrigerant and the medium (such as air) outside said condenser; an expansion valve; and an evaporator for exchanging heat between said refrigerant and the medium (such as air) outside said evaporator, wherein the refrigerant circulation line downstream of said compressor and upstream of said expansion valve constitutes a high pressure refrigerant line, and the refrigerant circulation line downstream of said expansion valve and upstream of said compressor constitutes a low pressure refrigerant line, said system further comprising: an energy-supplying mechanism for exerting energy onto the refrigerant when at least either the line length between said compressor and said expansion valve in the high pressure refrigerant line or the line length between said expansion valve and said compressor in the low pressure refrigerant line is longer than a predetermined value. According to this aspect, the pressure decrease in the vicinity of the expansion valve in the high pressure refrigerant line due to the pressure loss in piping can efficiently be compensated for.

In each foregoing heat pump system, the energy-supplying mechanism is provided preferably in the low pressure refrigerant line. According to this aspect, more liquid refrigerant in the low pressure refrigerant line is vaporized and then introduced into the compressor and discharged therefrom to the high pressure refrigerant line. When the discharge pressure of the compressor and the amount of the refrigerant discharging from the compressor are increased, the radiation area per refrigerant weight/time is reduced due to an increase in discharging refrigerant flow, thereby reducing the condensation volume and preventing the pressure decrease upon passing the condenser. Due to the increase in the discharge pressure and in the pressure upon passing the condenser, it is possible to prevent the pressure decrease in the high refrigerant line upstream of the expansion valve, which is caused by head difference and pressure loss in piping occurring between the condenser and the expansion valve, i.e., stable cooling, freezing, or heating operation is achieved. Further, the system preferably further comprises an accumulator for accumulating a liquid refrigerant provided in the low pressure refrigerant line, said accumulator comprising refrigerant-heating means for heating the liquid refrigerant in said accumulator, wherein said energy-supplying mechanism is said refrigerant-heating means. By using the accumulator, vaporization of the liquid refrigerant in the low pressure refrigerant line can be more certain.

In addition, each foregoing heat pump system preferably further comprises a four-way valve for reversing the flow of said refrigerant at said condenser and at said evaporator to switch the operation mode between the heating mode and the cooling mode, said four-way valve being provided downstream of said compressor, wherein said condenser is an inside heat-exchanger when in the heating mode and is an outside heat-exchanger when in the cooling mode, and said evaporator is said inside heat-exchanger when in the cooling mode and is said outside heat-exchanger when in the heating mode, wherein said energy-supplying mechanism is provided either in the high pressure refrigerant line between said compressor and said four-way valve or in the low pressure refrigerant line between said four-way valve and said compressor. In the aspect wherein the energy-supplying mechanism is provided in the high pressure refrigerant line, it is possible in the cooling or heating mode to compensate for the pressure decrease in the high pressure refrigerant line caused by head difference and pressure loss in piping by directly exerting energy onto the refrigerant in the high pressure refrigerant line. In the aspect wherein the energy-supplying mechanism is provided in the low pressure refrigerant line, more liquid refrigerant in the low pressure refrigerant line is vaporized, and then introduced into the compressor and discharged therefrom to the high pressure refrigerant line. When the discharge pressure of the compressor and the amount of the refrigerant discharging from the compressor are increased, the radiation area per refrigerant weight/time is reduced due to an increase in discharging refrigerant flow, thereby reducing the condensation volume and preventing the pressure decrease upon passing the condenser. Due to the increase in the discharge pressure and in the pressure upon passing the condenser, it is possible in the cooling or heating mode to prevent the pressure decrease in the high refrigerant line upstream of the expansion valve, which is caused by head difference and pressure loss in piping occurring between the condenser and the expansion valve.

Preferably, the heat pump system with the four-way valve further comprises an accumulator for accumulating a liquid refrigerant provided in the low pressure refrigerant line between said four-way valve and said compressor, said accumulator comprising refrigerant-heating means for heating the liquid refrigerant in said accumulator, wherein said energy-supplying mechanism is said refrigerant-heating means. By using the accumulator, vaporization of the liquid refrigerant in the low pressure refrigerant line can be more certain. The heat pump system with the four-way valve preferably further comprises a water-cooled engine for driving said compressor; and a cooling water heat-exchanger for exchanging heat between the cooling water circulating therethrough, which has absorbed heat from said water-cooled engine, and the refrigerant circulating therethrough, wherein said energy-supplying mechanism is said cooling water heat-exchanger. According to this aspect, the exhaust heat from the engine, which was heretofore wasted, can be used effectively, thereby preventing the pressure decrease in the high refrigerant line upstream of the expansion valve, which is caused by head difference and pressure loss in piping occurring between the condenser and the expansion valve.

The present invention is adapted to be embodied in both a heat pump system and a heat pumping method. Further, the present invention is also adapted to be embodied in air-conditioning apparatuses for heating or cooling and refrigerators, which are either engine-driven or electric motor-driven. The medium whose temperature is controlled is normally air. However, media other than air, such as water, fermentation fluids, and other fluids, can be heated or cooled. In the above, the compressor, the condenser, the expansion valve, the evaporator, and the like are used as generic terms, and each can be composed of plural members, e.g., the compressor can be composed of plural compressors. Switching between the heating mode and the cooling mode can be conducted using a four-way valve for reversing the refrigerant flow, i.e., an inside heat-exchanger and an outside heat-exchanger function as the condenser and the evaporator, respectively, in the heating mode, and they perform the opposite functions in the cooling mode.

DETAILED DESCRIPTION OF THE PREFERRED EMBODIMENT

Referring now in detail to the drawings, an air-conditioning apparatus is shown. The invention is shown in conjunction with an engine-driven air-conditioning apparatus for heating or cooling, since the invention has particular utility in conjunction with an engine. However, the invention can be embodied in conjunction with a refrigerator, and with an electric motor-driven heat pump system. Those skilled in the art can readily understand how the invention can be utilized with any known type of heat pump system.

In the present invention, an inside heat-exchanger is a heat-exchanger for exchanging heat between the refrigerant in a refrigerant circulation line of a heat pump system and the air inside a room of a building or inside a storage compartment (inner compartment) of a refrigerator. An outside heat-exchanger is, on the other hand, a heat-exchanger for exchanging heat between the refrigerant in the refrigerant circulation line of the heat pump system and the air outside the room of the building or outside the storage compartment (inner compartment) of the refrigerator; the outside heat-exchanger can be installed outside or inside the room (normally outside the room) in which the refrigerator is installed.

Basic Control System

Figure 1:
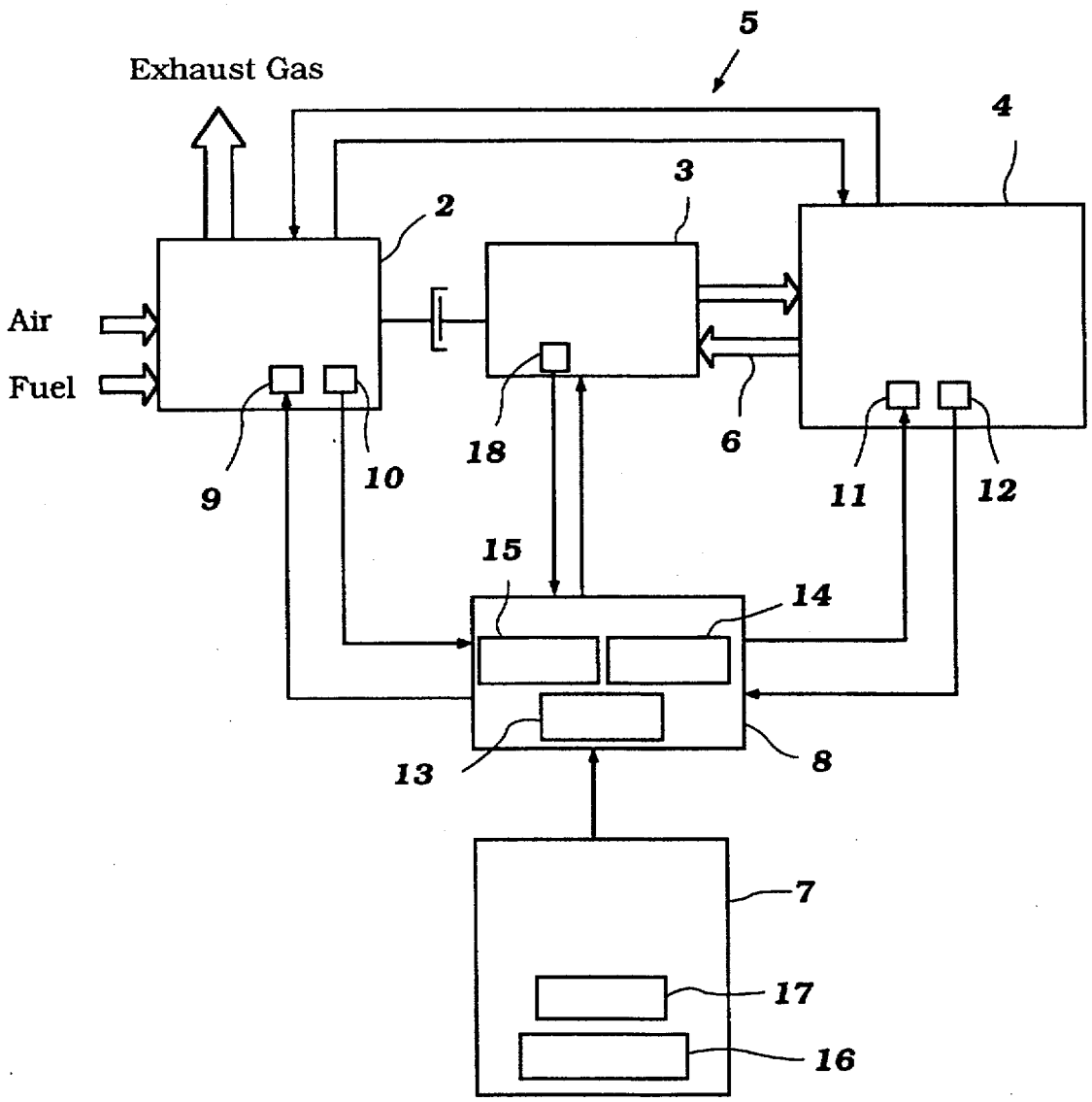
FIG. 1 is a schematic illustration showing basic structures of an engine-driven heat pump system used as an air conditioning apparatus according to an embodiment of the present invention.

FIG. 1 is a schematic illustration showing basic structures of an engine-driven heat pump system used as an air conditioning apparatus according to an embodiment of the present invention.

An air-conditioning apparatus 1 functioning as a heat pump system comprises an engine unit 2 functioning as a driving power (an electric motor can be used instead), a compressor system unit 3, a heat pump unit 4, a hot water circulation line 5 in which cooling water from the engine unit 2 circulates between the engine unit 2 and the heat pump unit 4, and a refrigerant circulation line 6 in which pressurized refrigerant such as Freon circulates between the compressor system unit 3 and the heat pump unit 4. The engine unit 2, the compressor system unit 3, and the heat pump unit 4 are controlled by a control unit 8 according to signals from an operation unit 7.

The engine unit 2 is provided with an actuator unit 9 and a sensor unit 10, and information on engine performance from the sensor unit 10 is transmitted to the control unit 8 which then outputs signals to the actuator unit 9 controlling the engine unit 2. In the engine system, a mixed gas of air and fuel gas is introduced through an induction system, and ignition occurs, followed by discharging exhaust gas through an exhaust system.

The compressor system unit 3 is comprised of plural compressors, and the number of engaged compressors (compressors in operation) of the compressor system unit 3 is controlled by signals from the control unit 8, depending on the air-conditioning load. The compressor system unit 3 is provided with an engaged-compressor detection means 18, from which performance information on the compressors is transmitted to the control unit 8. The heat pump unit 4 is operated by operation of the compressor system unit 3 via the refrigerant circulation line 6.

The heat pump unit 4 is comprised of an actuator unit 11 and a sensor unit 12, and information on heat pump performance from the sensor unit 12 is transmitted to the control unit 8 which then outputs signals to the actuator unit 11 controlling heating or cooling operation.

The control unit 8 is provided with a control means 13, a memory means 14, and a drive means 15. The control means 13 controls the drive means 15 based on the instructions from the operation unit 7, the information stored in the memory means 14, the information on engine performance from the sensor unit 10, and the information on heat pump performance from the sensor unit 12. By the drive means 15, the actuator unit 9, the compressor system unit 3, and the actuator unit 11 of the heat pump unit 4 are driven.

The operation unit 7 is provided with a switch unit 16 and a display unit 17. When an operator manipulates the switch unit 16, signals are transmitted to the control unit 8 so as to engage the heat pump system 1, and operation performance is indicated on the display unit 17.

Hereinafter, first, structures of a heat pump system according to the present invention will be described with reference to the drawings, and then the functions and effects of particular structures related to the present invention will be explained.

Structures of Air-Conditioning Apparatus

Figure 2:
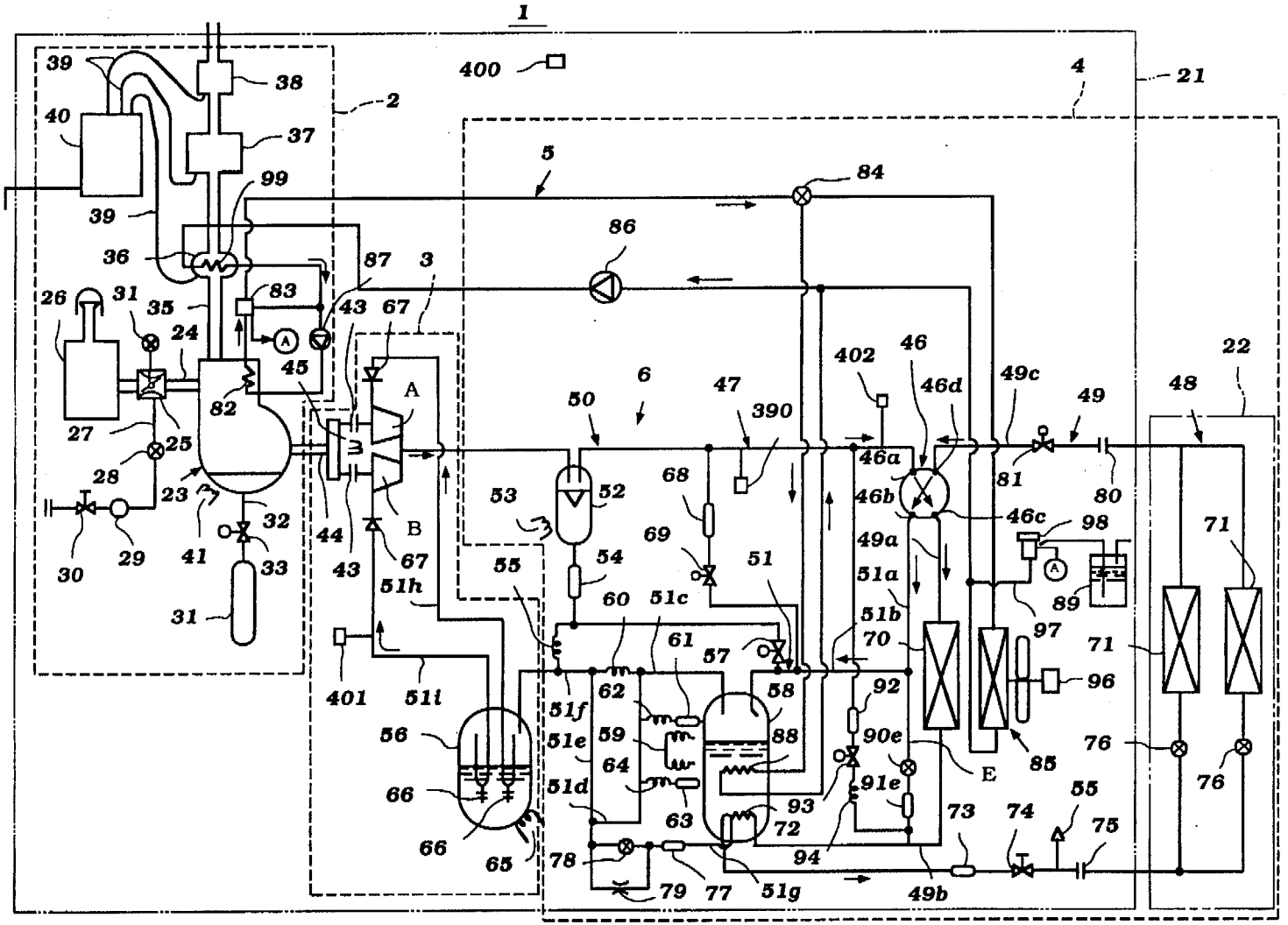
FIG. 2 is a schematic circuit illustrating structures of an engine-driven heat pump system used as an air-conditioning apparatus when in the cooling mode according to a first embodiment of the present invention.

Referring in detail to the drawings, and to a first embodiment shown in FIGS. 2–8 initially by reference to FIG. 2, an air-conditioning apparatus 1 (engine-driven) functioning as a heat pump system is shown.

The air-conditioning apparatus 1 comprises an outside unit 21 and an inside unit 22. An engine unit 2, a compressor unit 3, a hot water circulation line 5, and a refrigerant circulation line 6 are provided in the outside unit 21. A heat pump unit 4 is constituted by the inside unit 22 and a part of the outside unit 21.

The engine unit 2 includes a water-cooled engine 23, to which a mixer 25 and an air cleaner 26 are connected via an induction manifold 24. Air is supplied to the mixer 25 through the air cleaner 26. A fuel supply control valve 28 operated by a pulse motor, a reduced-pressure control valve 29, and an electromagnetic valve (gas on-off valve) 30 are connected to the mixer 25 via a connection pipe 27, thereby supplying fuel gas to the mixer 25. Fuel gas and air are mixed in the mixer 25 by means of a throttle driven by a pulsation motor (surbo-motor) 31, and then introduced into the water-cooled engine 23.

A replenishing control valve is connected to the water-cooled engine 23 via an oil (lubricant) replenishing line 32 leading to an oil (lubricant) tank 34 disposed at an upper position so that when the amount of oil is decreased, the replenishing control valve is automatically opened, and oil is supplied to the water-cooled engine 23 by gravity from the oil (lubricant) tank 34.

A muffler 36, an exhaust silencer 37, and a mist separator 38 are also connected to the water-cooled engine 23 via an exhaust pipe 35. Exhaust from the water-cooled engine 23 is cooled while flowing through the muffler 36 and the exhaust silencer 37, thereby generating drain water with acidic material separated from exhaust gas. Also, in the mist separator 38, drain water with acidic material is separated from exhaust gas. The above drain waters are fed to a drain neutralizer 40 via respective pipes 39, in which the drain water is neutralized, thereby being discharged. The engine unit 2 is provided with a heater 41 which controls the temperature of oil in an oil pan in the water-cooled engine 23.

The compressor system unit 3 has two compressors A and B, both of which are connected to a drive shaft 44 of the water-cooled engine 23 via respective electromagnetic clutches 43. These electromagnetic clutches 43 can be engaged or disengaged using clutch drive members (not shown). Referential numeral 45 is a heater for controlling the temperature of oil in the compressors A and B, and is activated at start-up at a low temperature.

The refrigerant circulation line 6 permits refrigerant to be compressed, circulated, vaporized, and liquefied, thereby performing heat-pumping. The refrigerant circulation line 6 is constituted by a basal circulation line 47 from the compressors A and B of the compressor system unit 3 to a four-way valve 46; an inside circulation line 48 accommodated in the inside unit 22; and an outside circulation line 49 disposed between the basal circulation line 47 and the inside circulation line 48.

The basal circulation line 47 is constituted by a discharge circulation line 50 connected to the compressors A and B on the discharging side and communicated to a first port **46*a* of the four-way valve 46, and a intake circulation line 51 connected to the compressors A and B on the intake side and communicated to a second port 46*b* of the four-way valve 46. The discharge circulation line 50 is provided with an oil separator 52 having a heater 53 that controls the temperature of the oil separator 52. The oil separator 52 permits oil to return to a line upstream of a subaccumulator 56 through a capillary tube 55 via a strainer 54, and also to return to a line upstream of an accumulator 58 via an electromagnetic valve 57. The electromagnetic valve 57 opens normally at start-up when oil abundantly discharged from the compressors A and B accumulates in the oil separator 52; otherwise, the valve 57** is closed.

The subaccumulator 56 and the accumulator 58 are provided in the intake circulation line 51. The accumulator 58 accommodates both liquid and vapor refrigerant therein. The vapor refrigerant is transferred to the subaccumulator 56 via a line **51*c* through a capillary tube 60, and via lines 51*d*, 51*e*, and 51*f*, and further via the lines 51*d*, 51*e*, and 51*f* through a strainer 61 and a capillary tube 62. The liquid refrigerant accommodated in the accumulator 58 is transferred to the subaccumulator 56 via the lines 51*d*, 51*e*, and 51*f* through a strainer 63 and a capillary tube 64. A heater 59 controls the temperature at the capillary tubes 62 and 64, and the strainers 61 and 63. Each of the strainers 61 and 63 is provided with a temperature sensor for sensing the low-temperature liquid refrigerant passing through the respective strainers, thereby detecting whether or not the surface of the liquid refrigerant is located between the strainers 61 and 63. In addition, the oil in the accumulator 58 is transferred from the lower part of the accumulator 58 to the subaccumulator 56 via a line 51*g* through a strainer 77 and a control valve 78 or an orifice 79, and via the lines 51*e* and 51*f***.

The subaccumulator 56 is provided with a heater 56 that controls the temperature of the subaccumulator 56. The vapor refrigerant in the subaccumulator 56 is introduced into the compressors A and B via lines **51*h* and 51*i* through respective one-way valves. The oil accommodated in the subaccumulator 56 is slowly taken into the compressors A and B via an orifice 66. The discharge circulation line 50 is connected to the intake circulation line 51 via a strainer 68 and an electromagnetic valve 69** that open when the pressure is irregularly high, thereby preventing the occurrence of irregularly high pressure.

A third port **46*c* of the four-way valve 46 is connected to a line 49*a* which constitutes the outside circulation line 49, and which includes an outside heat-exchanger 70. A heat-exchanger 72, a strainer 73, a line 49*b* provided with a manual valve 74, a joint (coupler) 75, and an electrical expansion valve 76 are provided between the outside heat-exchanger 70 and inside heat-exchangers 71 included in the inside circulation line 48**.

The inside heat-exchangers 71 are connected to the inside circulation line 48, and is communicated to a fourth port **46*d* of the four-way valve 46 positioned between the basal circulation line 47 and the outside circulation line 48 via a joint (coupler) 80, a line 49*c* constituting the outside circulation line 49, and a manual valve 81** positioned therebetween.

The intake circulation line 51 is connected to a line **49*b* constituting the outside circulation line 49 via a flow control valve 90*e* and a strainer 91*e*, and the discharge circulation line 50 is connected to the line 49*b* via a strainer 92, an electromagnetic valve 93, and a capillary tube 94**.

The hot water line 5 comprises a heat-exchanger 82 provided in the water-cooled engine 23 that is a heat source of hot water, and a heat-exchanger 99 provided in a muffler 36, in which hot water is circulated by pumps 86 and 87 through a switch valve 83 having a thermostat, a three-way valve 84, a radiator 85, the pump 86, the heat-exchanger 99, and the pump 87, in sequence. The radiator 85 is provided with a cooling fan 96. The air and water vapor are returned to a conduction assembly (water-pouring hole cap) 98 through the switch valve 83, and then discharged to the atmosphere through the conduction assembly 98. A recovery tank (cooling water replenishing tank) 89 for supplying cooling water is connected to the conduction assembly 89, and the cooling water is supplied between the radiator 85 and the pump 86 via a cooling water pipe 97 from the conduction assembly 98.

At start-up, hot water is circulated using the pump 87 in a loop via the heat-exchanger 82 by manipulating the switch valve 83 until the temperature of the hot water reaches a given value.

Hot water is fed to the heat-exchanger 88 positioned in the accumulator 58 by manipulating the three-way valve 84, thereby promoting vaporization of liquid refrigerant accommodated in the accumulator 58.

Thus, when operating the heat pump system 1 having the above structures for cooling a room, as shown in FIG. 2, the four-way valve 46 is controlled in such a way as to connect the first port **46*a* and the third port 46*c*, and concurrently the fourth port 46*d* and the second port 46*b***.

Accordingly, refrigerant is compressed by the compressors A and B driven by the water-cooled engine 23, whereby the generated high-temperature high-pressure vaporized refrigerant is cooled by the outside air so as to be liquefied in the outside heat-exchanger 70 of the outside unit 21. The liquefied refrigerant is decompressed (subjected to pressure decrease) by the function of the expansion valve 76, and the refrigerant under low pressure is vaporized in the inside heat-exchanger 71 of the inside unit 22, while absorbing heat from the inside air. The heat of evaporation drives the cooling effect to cool the room. The evaporated refrigerant is returned to the compressors A and B, and the same cycle is repeated. Hot water, which circulates through a hot water beat-exchanger 88 via the three-way valve 84 from the hot water circulation line 5, supplies heat energy to liquid refrigerant in order to compensate for insufficient vaporization at the inside heat-exchanger 71, as well as to facilitate driving the compressors A and B.

Figure 3:
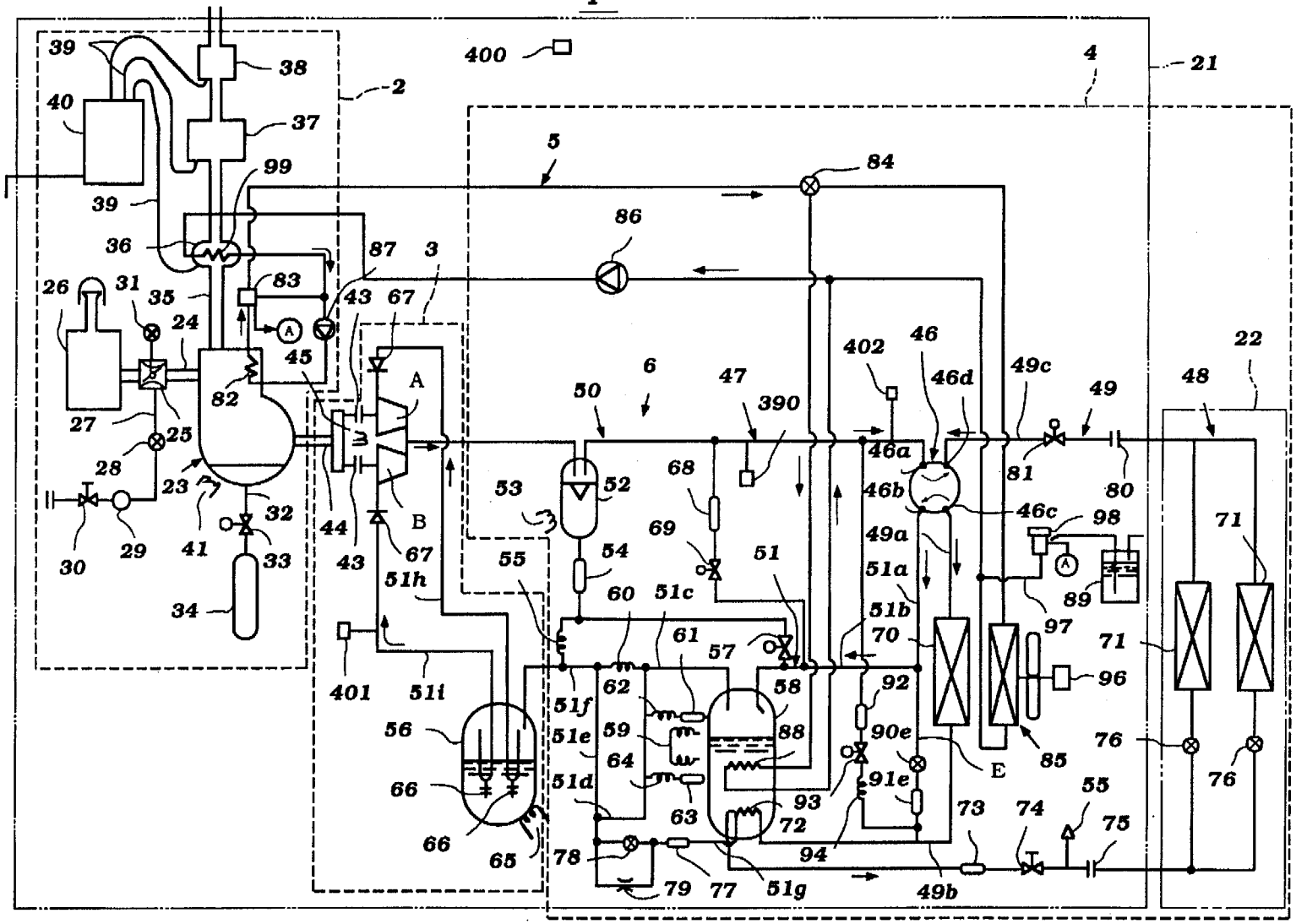
FIG. 3 is a schematic circuit illustrating structures of the air-conditioning apparatus of FIG. 2 when in the heating mode, according to an embodiment of the present invention.

When operating the heat pump system 1 for heating a room, as shown in FIG. 3, the four-way valve 46 is controlled in such a way as to connect the first port **46*a* and the through port 46*d*, and concurrently the third port 46*c* and the second port 46*b***.

Accordingly, refrigerant is compressed by the compressors A and B driven by the water-cooled engine 23, whereby the generated high-temperature high-pressure vaporized refrigerant is cooled by the outside air so as to be liquefied in the inside heat-exchangers 71 of the inside unit 22. In this process, the refrigerant radiates heat towards the inside air due to the heat of radiation so as to heat the room. The liquefied refrigerant is decompressed (subjected to pressure decrease) by the function of the expansion valve 76, and the refrigerant under low pressure is vaporized while absorbing heat from the outside air in the outside heat-exchanger 70 of the outside unit 21. The liquid refrigerant is separated in the accumulator 58, and the vapor refrigerant is returned to the compressors A and B, and the same cycle is repeated. Hot water, which circulates through a hot water heat-exchanger 88 via the three-way valve 84 from the hot water circulation line 5, supplies heat energy to liquid refrigerant in order to compensate for insufficient vaporization at the outside heat-exchanger 70, as well as for driving power of the compressors A and B.

The compressor system unit 3 of the air-conditioning apparatus 1 will be explained with reference to FIGS. 4–8.

Compressor System Unit

The compressor system unit 3 of the air-conditioning apparatus 1 comprises two multi-blade type compressors A and B which are driven by the water-cooled engine 23. The structures of one of the compressors, compressor A, are explained with reference to FIGS. 5–8. The structures of compressor B are the same as compressor A, and thus explanation of compressor B is omitted.

The compressor system unit 3 has a rotor housing 100, one side of which is affixed to a compressor casing 200 with clamping bolts (fasteners) 201. To the other side of the rotor housing 100, caps 300 to compressor A and B, respectively, are affixed with clamping bolts (fasteners) 301.

Figure 5:
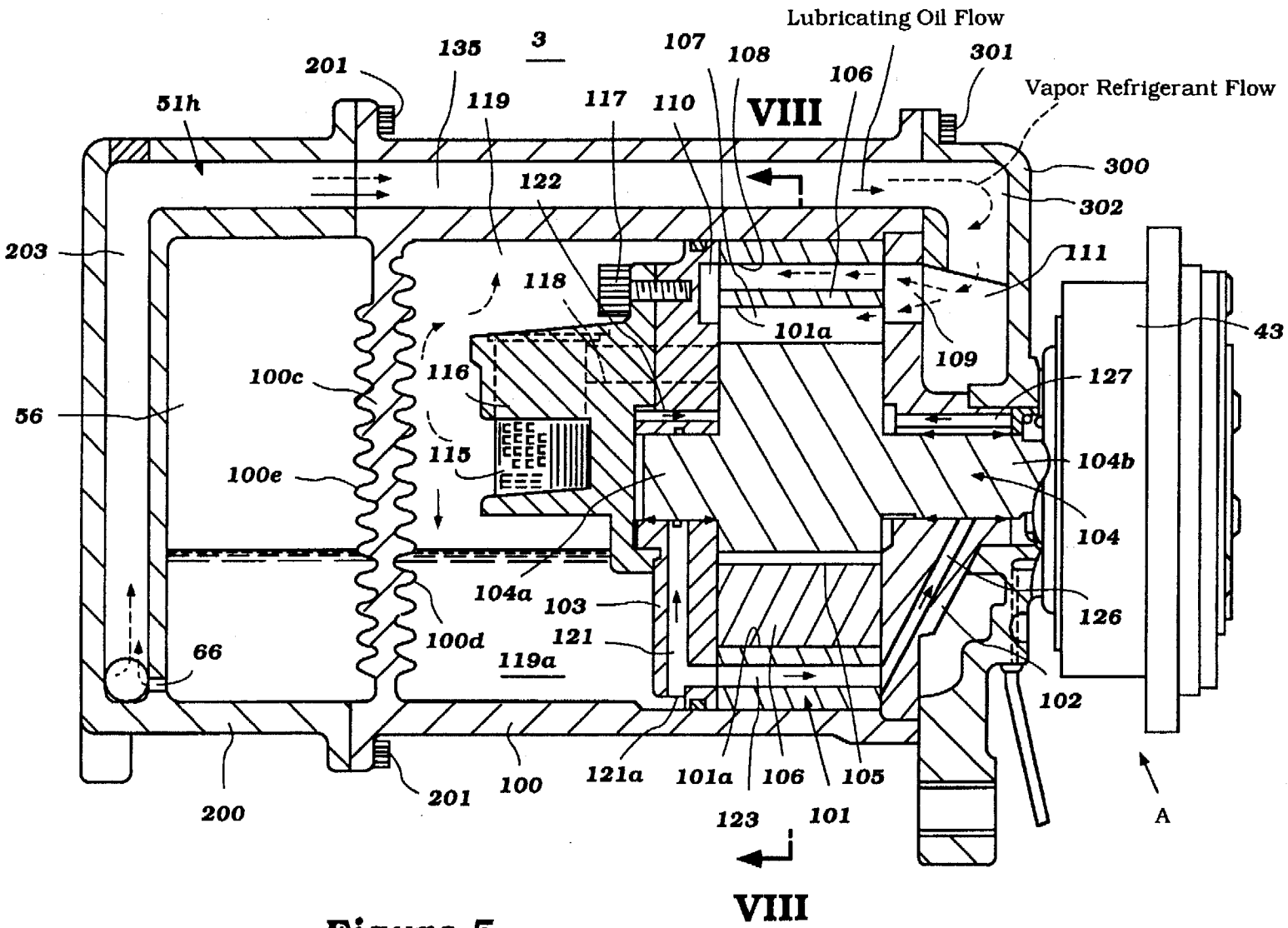
FIG. 5 is a schematic cross-sectional view of the compressor system of FIG. 4, which is cross-sectioned along the V—V line.
Figure 8:
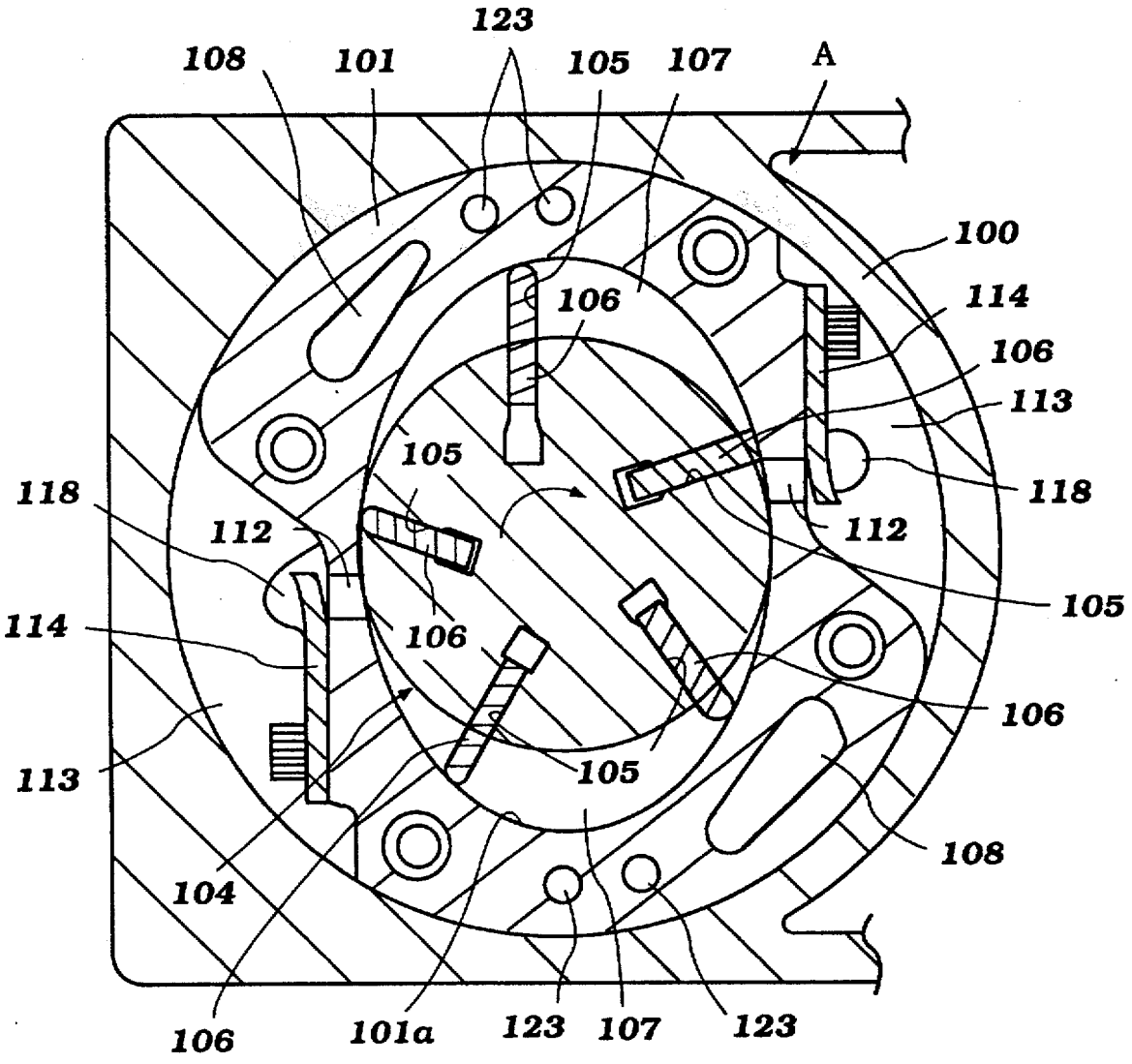
FIG. 8 is a schematic cross-sectional view of the compressor system of FIG. 4, which is cross-sectioned along the VIII—VIII line.

As shown in FIG. 5, in the rotor housing 100, a cylinder 101 is accommodated, and side blocks 102 and 103 are attached to respective ends of the cylinder 101. Also, in the cylinder 101, shafts **104*a* and 104*b* of a rotor 104 are pivoted to the side blocks 103 and 102 so as to make it freely rotatable. The rotor 104 has a main portion which has a large diameter and which is positioned between the shafts 104*a* and 104*b* in the cylinder 101. As shown in FIG. 8, the main portion has structures having five vane-sliding slots 105, each formed approximately in a radial direction. Into each sliding groove, a vane 106 is fitted in such a way as to freely slide in a radial direction, and when the rotor 104 rotates in the direction indicated by the arrow, each vane 106 revolves while the outer end of the blade slides upon the inner wall of a bore 101*a* having an elliptical cross-section. In the cylinder 101, five compartments (pumping chambers) 107 for induction and compression of refrigerant are defined by the rotor 104**.

The cylinder 101 is provided with a pair of induction conduits 108 which go through the cylinder 101 in the axis direction. Induction inlets 109 and 110, which are communicated to the induction and compression compartment 107, are formed in the side blocks 102 and 103, respectively (FIG. 5). The induction inlet 109 is communicated directly to the induction channel 111, and the induction inlet 110 is communicated to the induction channel 111 via the induction conduit 108. The induction channel 111 is formed between the side block 102 and the cap 300. As shown in FIG. 8, two discharge outlets 112, which are openings communicating to the induction and compression compartments 107, are formed, and each discharge outlet 112 is provided with a valve 114 which allows vapor refrigerant to flow from the induction and compression compartment 107 to a discharge compartment 113.

As shown in FIG. 5, a holder 116 having an oil separator 115 is affixed to the side block 103 with a hexagon socket head cap screw 117. The discharge compartment 113, which is formed by the side blocks 102 and 103, the rotor housing 100, and the cylinder 101, is communicated to the oil separator 115 via discharge conduit 118 that is an opening communicating to the discharge compartment 113. An oil reservoir (oil storage chamber) 119 wherein oil is stored in the lower part is formed behind the cylinder 101 in the rotor housing 100, in which lubricating oil 119*a* is stored. There is an opening, a discharge outlet 120, in the upper part of the rotor housing 100 above the oil reservoir 119, and the discharge outlet 120 is communicated to the discharge circulation line 50 (FIG. 7).

The oil reservoir 119 is also used as a high-pressure refrigerant chamber, and accommodates lubricating oil therein. There is an opening, an oil inlet 121*a*, in the lower part of the oil reservoir 119. The oil inlet 121*a* is communicated to an oil circulation conduit 121 formed in the side block 102. The oil circulation conduit 121 is led to the shaft unit 104*a* of the rotor 104 so as to supply lubricating oil, thereby lubricating the shaft unit. The side block 102 is also provided with an oil circulation conduit 122 which is communicated to the shaft unit 104*a* of the rotor 104. The lubricating oil, which has lubricated the shaft unit 104*a*, is then moved from the oil circulation conduit 122 to a gap between the side block 102 and the rotor 104, thereby lubricating therebetween (FIG. 5). Four oil circulation conduits 123 are formed in the cylinder 101. The oil circulation conduits 123 are communicated to the oil circulation conduit 121 of the side block 103. The side block 102 is provided with oil circulation conduits 126 and 127. The oil circulation conduit 126 is led to the shaft unit 104*b* of the rotor 104 via the oil circulation conduits 123 of the cylinder 101, thereby lubricating the shaft unit 104*b*. The oil circulation conduit 127 is communicated to the shaft unit 104*b* of the rotor 104, and the lubricating oil, which has lubricated the shaft unit 104*b*, is then moved to a gap between the side block 102 and the rotor 104 from the oil circulation conduit 127, thereby lubricating therebetween, and is led to the induction and compression compartment 107.

Figure 7:
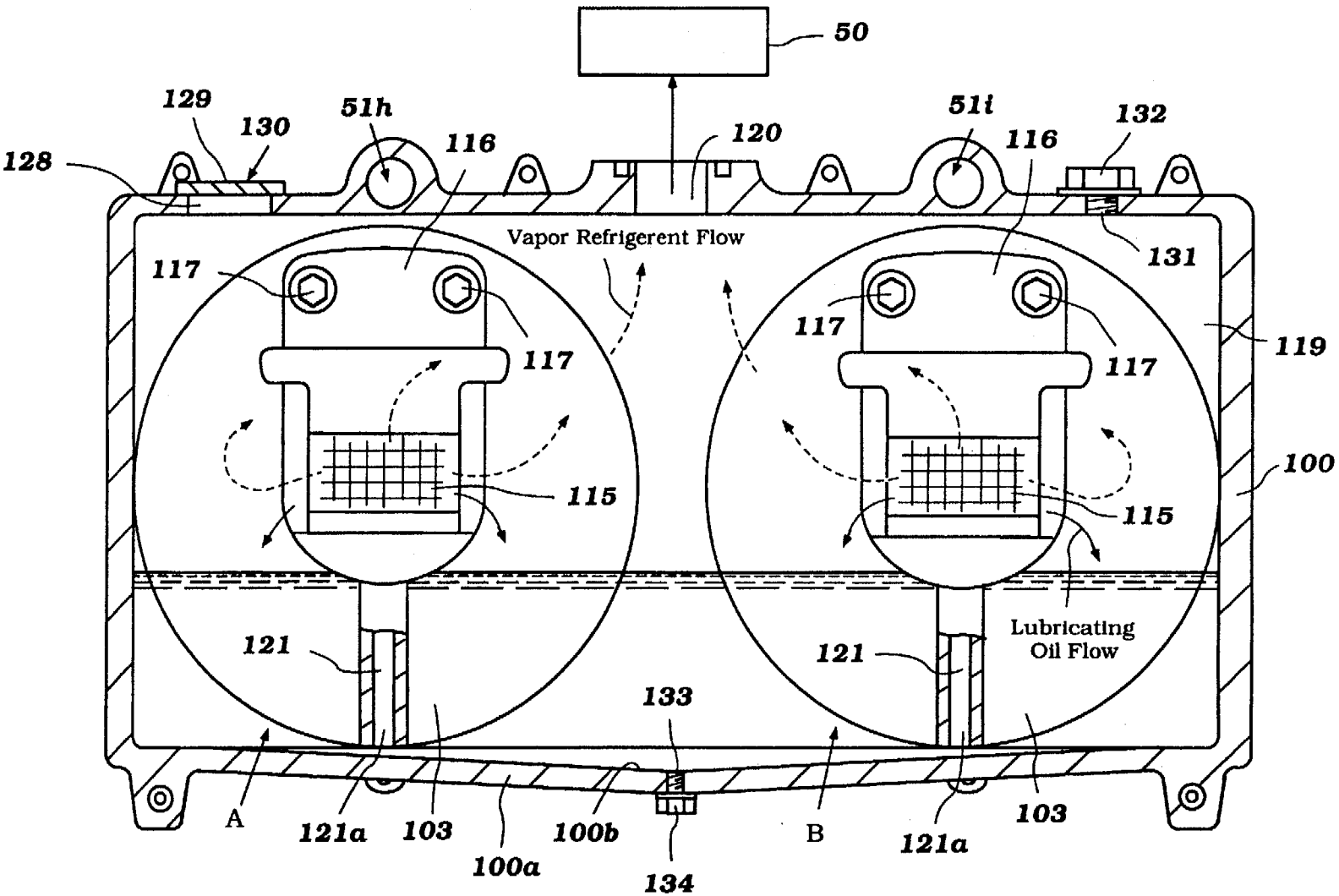
FIG. 7 is a schematic cross-sectional view of the compressor system of FIG. 4, which is cross-sectioned along the VII—VII line.

At the upper part of the rotor housing 100, an observation port 130 is provided by sealing an opening 128 with a transparent glass 129 (FIG. 7). An oil charging hole 131 is provided on the side opposite to the observation port 130. An oil charging hole cap (bolt) 132 is removed from the oil injection inlet 131, and oil is injected thereto. The bottom 100*a* of the rotor housing 100 is slanted so that the center 100*b* of the bottom 100*a* is made lower than the sides, whereby lubricating oil drainage can be accumulated therein. The center 100*b* of the bottom 100*a* is provided with an oil drain hole 133, through which lubricating oil is discharged and replaced, or drained at a certain time after removing a drain hole cap (bolt) 134.

The rotor housing 100 is attached to the compressor casing 200 with clamping bolts 201, and the oil reservoir 119 for accommodating lubricating oil therein and the subaccumulator 56 are contiguous to each other, in which a heat-exchange wall 100*c* formed in the rotor housing 100 is interposed therebetween (FIG. 5). The heat-exchange wall 100*c* is provided with fins 100*d* on the side of the oil reservoir 119, and also provided with fins 100*e* on the side of the subaccumulator 56, thereby enlarging the heat-exchanging area, and improving heat exchange efficiency.

Figure 4:
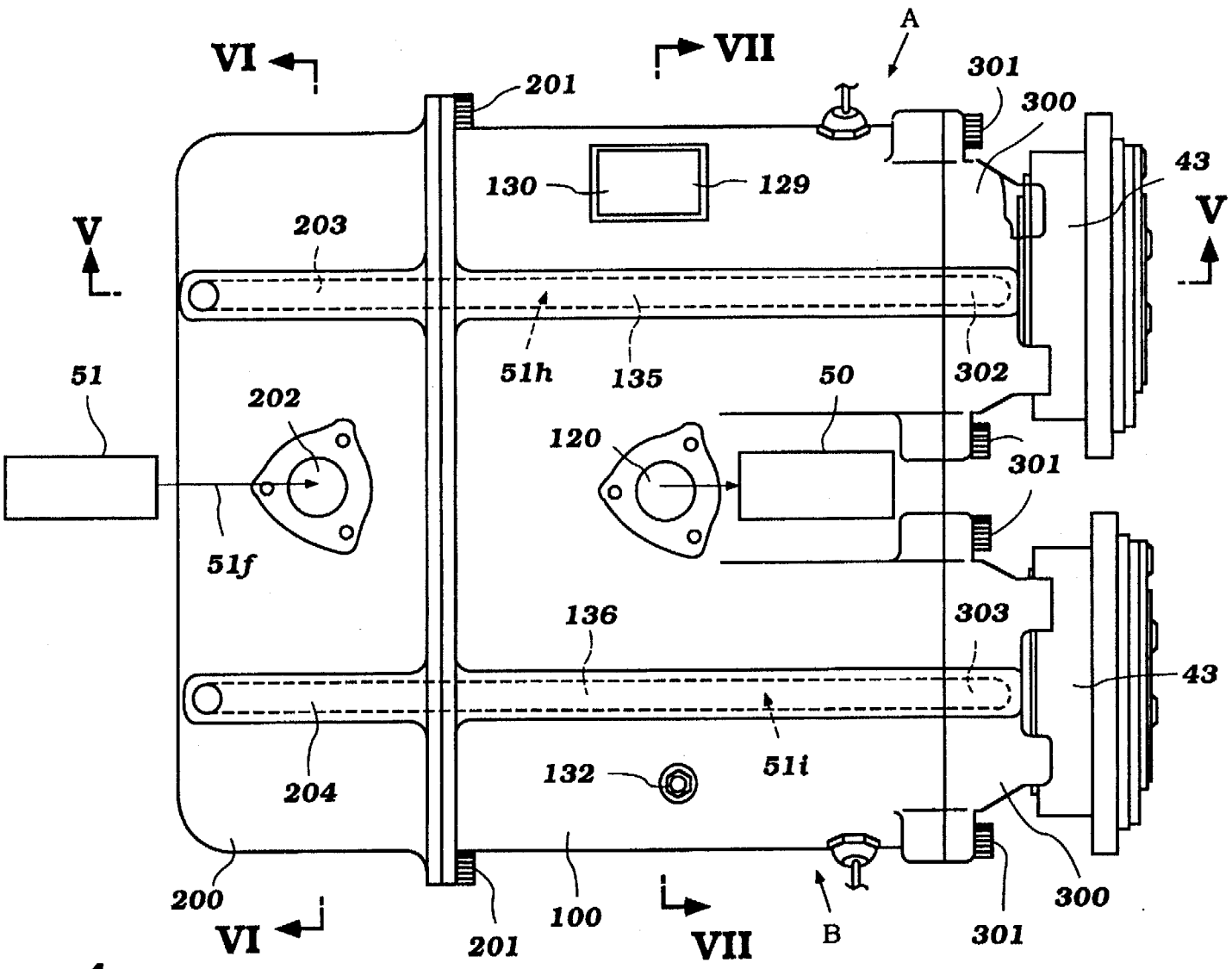
FIG. 4 is a schematic plane view illustrating a compressor system usable in the present invention.
Figure 6:
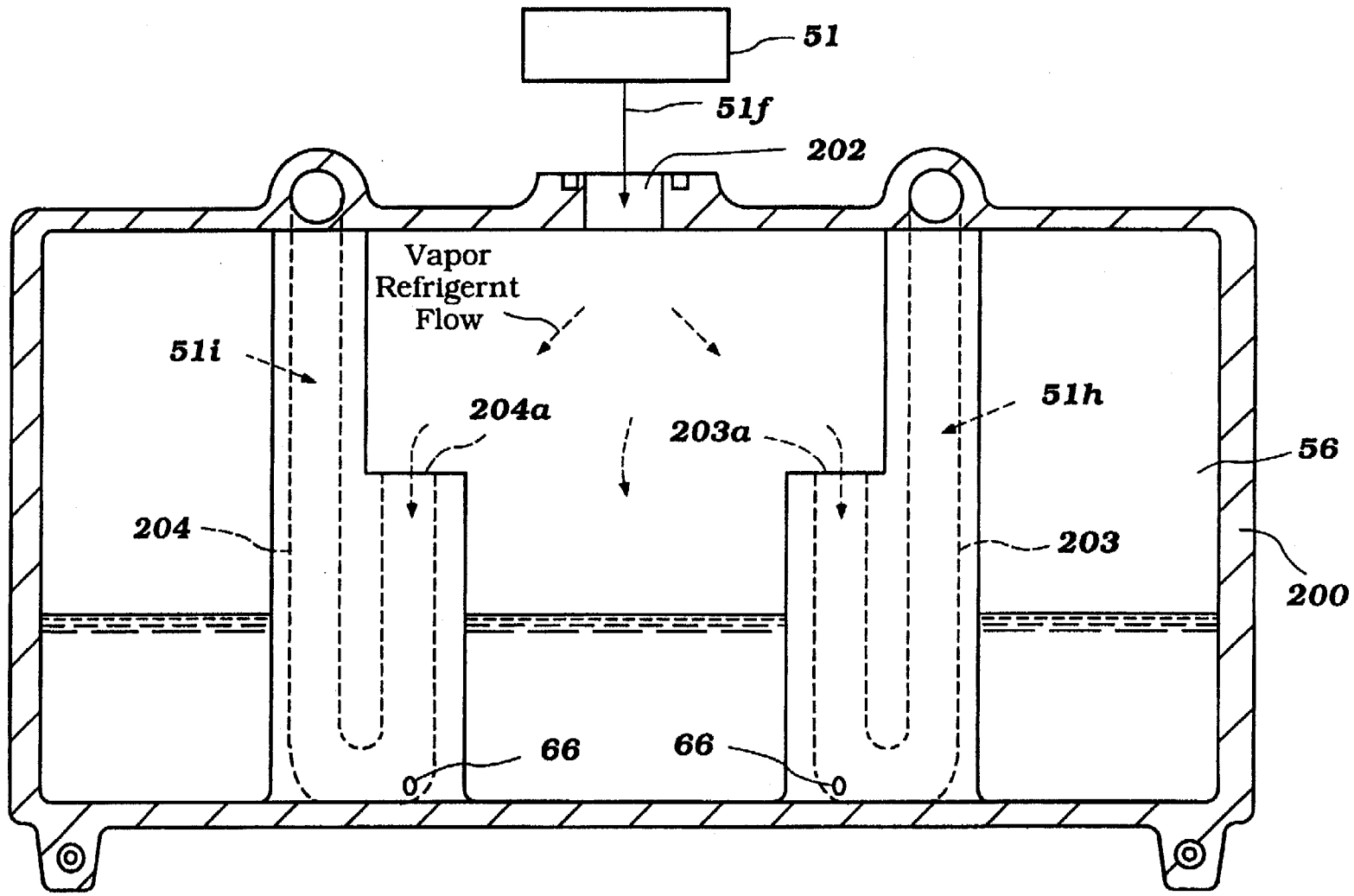
FIG. 6 is a schematic cross-sectional view of the compressor system of FIG. 4, which is cross-sectioned along the VI—VI line.

The subaccumulator 56 is a low pressure chamber, and the upper part of the subaccumulator 56 is provided with an opening, an induction inlet 202, connected to a circulation line 51*f* of the intake circulation line 51 (FIGS. 4 and 6). A pair of conduits 203 and 204 are formed from the side to the upper part of the compressor casing 200, and the conduits 203 and 204 are communicated to conduits 135 and 136, respectively, formed in the upper part of the rotor housing 100. The conduits 135 and 136 are communicated to conduits 302 and 303, respectively, formed in the cap 300. The conduits 302 and 303 are in turn communicated to the induction channel 111 (FIG. 5).

There are openings 203*a* and 204*a* in the middle of the subaccumulator 56, which are communicated to the conduits 203 and 204, respectively (FIG. 6). Through the openings 203*a* and 204*a*, vapor refrigerant present in the subaccumulator 56 is taken by and introduced into the compressors A and B in operation, respectively. That is, by operation of the compressor A, vapor refrigerant present in the subaccumulator 56 is taken into the compressor A via the conduits 203, 135, and 302, and the induction channel 111, thereby forming a circulation line 51*h* (FIG. 5). On the other hands, by operation of the compressor B, vapor refrigerant present in the subaccumulator 56 is taken into the compressor B via the conduits 204, 136, and 303, and the induction channel 111, thereby forming a circulation line 51*i*.

The lubricating oil remaining in the subaccumulator 56 are slowly taken into the compressors A and B through an orifice 66.

Accordingly, by adjoining the oil reservoir 119 for accommodating lubricating oil and the subaccumulator 56 via the heat-exchange wall 100*c* interposed therebetween, and further by integrating the compressors A and B and the subaccumulator 56, it is possible to eliminate piping connecting the compressors A and B and the subaccumulator 56, reduce the production cost, and downsize the apparatus.

Further, by adjoining the oil reservoir 119 for accommodating lubricating oil and the subaccumulator 56 via the heat-exchange wall 100*c* interposed therebetween, lubricating oil present in the oil reservoir 119 is cooled by exchanging heat between the oil and the liquid refrigerant present in the subaccumulator 56, and it is possible to eliminate a specific radiator for cooling the lubricating oil, thus reducing the production cost. On the other hand, the refrigerant in the subaccumulator 56 is concurrently heated by the lubricating oil in the oil reservoir 119.

In brief, each rotor 104 of the compressors A and B is provided with an electromagnetic clutch 43 at the end of the rotor, and driving power generated by the water-cooled engine 23 is transmitted to the rotor 104 according to the ON/OFF operation of the electromagnetic clutch 43. When driving power is transmitted to the rotor 104 and the rotor 104 starts rotation, the vanes 106 revolves together. The vanes 106 slide upon the walls of the vane-sliding slots 105 in the outward direction, thereby revolving while the edges of the vanes 106 slide upon the wall of the bore 101*a* of the cylinder 101. Vapor refrigerant is taken into the compression compartment 107 in the cylinder 101 via the induction channel 111, the induction inlet 109, and the induction conduit 108. The vapor refrigerant is then compressed by the vanes 106, thus turning it into high-temperature high-pressure vapor refrigerant, which is discharged to the discharge compartments 113 via the discharge outlets 112 and the valves 114 (FIG. 8). The vapor refrigerant discharged to the discharge compartment 113 reaches the oil separator 115 via the discharge conduit 118, where the oil portion is separated therefrom, flows into the oil reservoir 119, and is finally discharged to the discharge circulation line 50 which is an outside system through the discharge outlet 120 (FIG. 7).

As explained above, the compressors A and B are provided with the conduits to circulate lubricating oil in the liquid refrigerant accommodated in the subaccumulator 56, thereby exchanging heat between the lubricating oil and the refrigerant. Thus, a special radiator for cooling lubricating oil can be eliminated, thereby reducing the production cost.

The lubricating oil, which has been separated from the liquid refrigerant by the oil separator 115, drips from the oil separator 115 and is accommodated in the lower part of the oil reservoir 119. The lubricating oil then flows from the oil inlet 121*a* towards the direction indicated by the arrow in FIG. 5 via the oil circulation conduits 121, 122, 126, and 127, and lubricates the shaft unit of the rotor 104, the gap between the rotor 104 and the side blocks 102 and 103, and the sliding area of the bore 101*a* and the vanes 106, especially the area under low pressure. The lubricating oil then moves to the pumping chamber 107 and further to the outlet conduit 118 and the oil separator 115, and drips to return to the oil reservoir 119 by dripping.

At start-up, the vapor refrigerant including lubricating oil, which has been liquefied inside the bore 101*a* and inside the conduits 51*h* and 51*i* located between the subaccumulator 56 and the compressors A and B, turns into foam, and is discharged to the discharge circulation line 50, i.e., outside the compressor system unit, via the discharge outlet 120 of the oil reservoir 119. The lubricating oil contained in vapor refrigerant, which is in the form of foam, is accommodated in the oil separator 52 in the discharge circulation line 50 (FIG. 2), and moves to the accumulator 58 via the electromagnetic valve 57 which opens after a given time elapses.

The lubricating oil accommodated at the bottom of the accumulator 58 returns through the lower part of the accumulator 58 to the subaccumulator 56 which is integrated with the compressors A and B via the conduit 58*g*, the strainer 77, the control valve 78, the orifice 79, the lines 51*e* and 51*f*.

The lubricating oil is slowly taken from the subaccumulator 56 to the compressors A and B through the orifice 66, moves into the bore 101*a* with vapor refrigerant, returns to the oil separator 115 via the discharge conduit 118, and drips from the oil separator 115 to return to the oil separator 52. After a given time elapses, the electromagnetic valve 57 closes, the circulation of the lubricating oil accommodated in the oil separator 52 via the electromagnetic valve 57 is discontinued. The lubricating oil accommodated in the oil separator 52 is slowly circulated via the capillary tube 55 during operation.

Refrigerant Flow Control System

Figure 9:
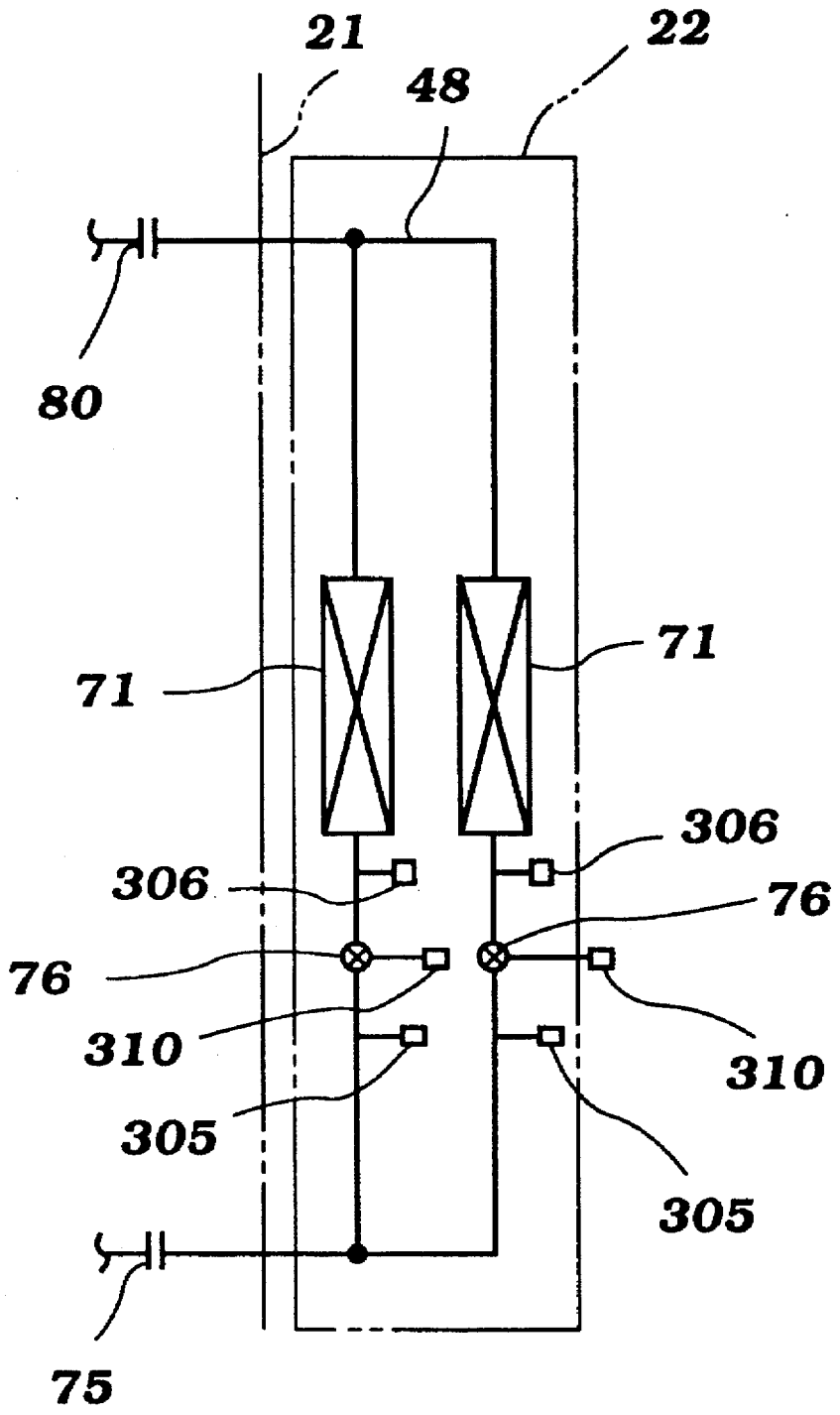
FIG. 9 is a schematic partial circuit illustrating structures of an inside heat-exchanger unit which replaces that of an engine-driven air conditioning apparatus of FIG. 2 or 3, according to a second embodiment of the present invention.

The air-conditioning apparatus shown in FIGS. 1–3, particularly in the cooling mode shown in FIG. 2, represents a first embodiment of the present invention. FIG. 9 shows an inside unit 22*a*, a second embodiment of the present invention, replacing the inside unit 22 of the first embodiment.

FIG. 9 shows a schematic enlarged view of the inside unit 22*a* of the second embodiment. An expansion valve 76 used in the inside unit 22*a* is a linearly controlled expansion valve. A pressure sensor 305 for sensing high pressure when in the cooling mode is provided in the line upstream of the expansion valve 76, and a pressure sensor 306 for sensing low pressure when in the cooling mode is provided in the line downstream of the expansion valve 76. In addition, an expansion valve-opening sensor 310 for sensing the volume of refrigerant passing therethrough is provided in the expansion valve 76. When in the heating mode, the pressure sensor 305 senses low pressure, and the pressure sensor 306 senses high pressure, since the refrigerant flow is reversed when the operation mode is switched.

Refrigerant Flow Control System against Pressure Loss

Figure 10:
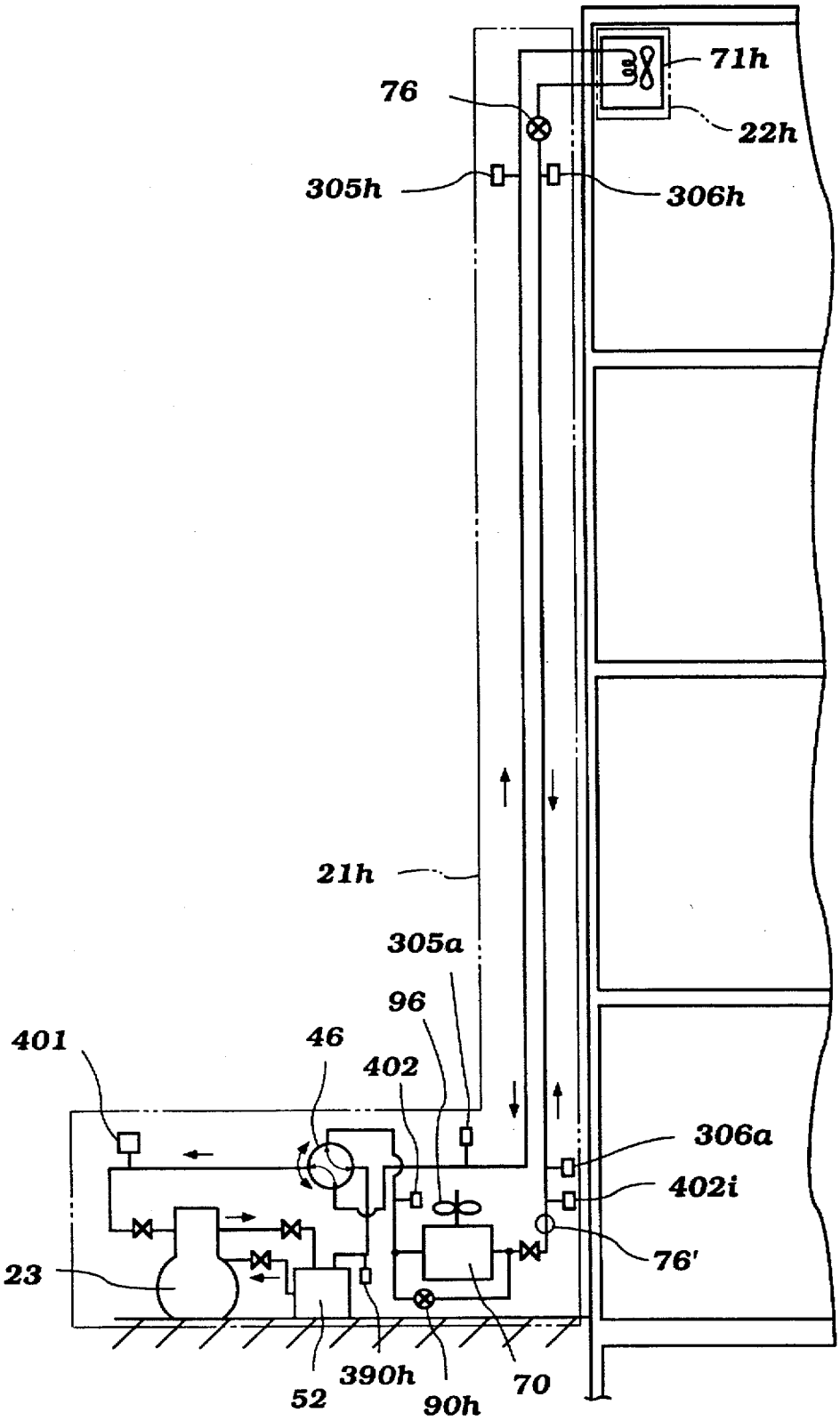
FIG. 10 is a schematic cross-sectional vertical view illustrating structures of an air-conditioning apparatus in the cooling mode, according to the present invention, in which an inside unit is placed on the fourth floor.
Figure 11:
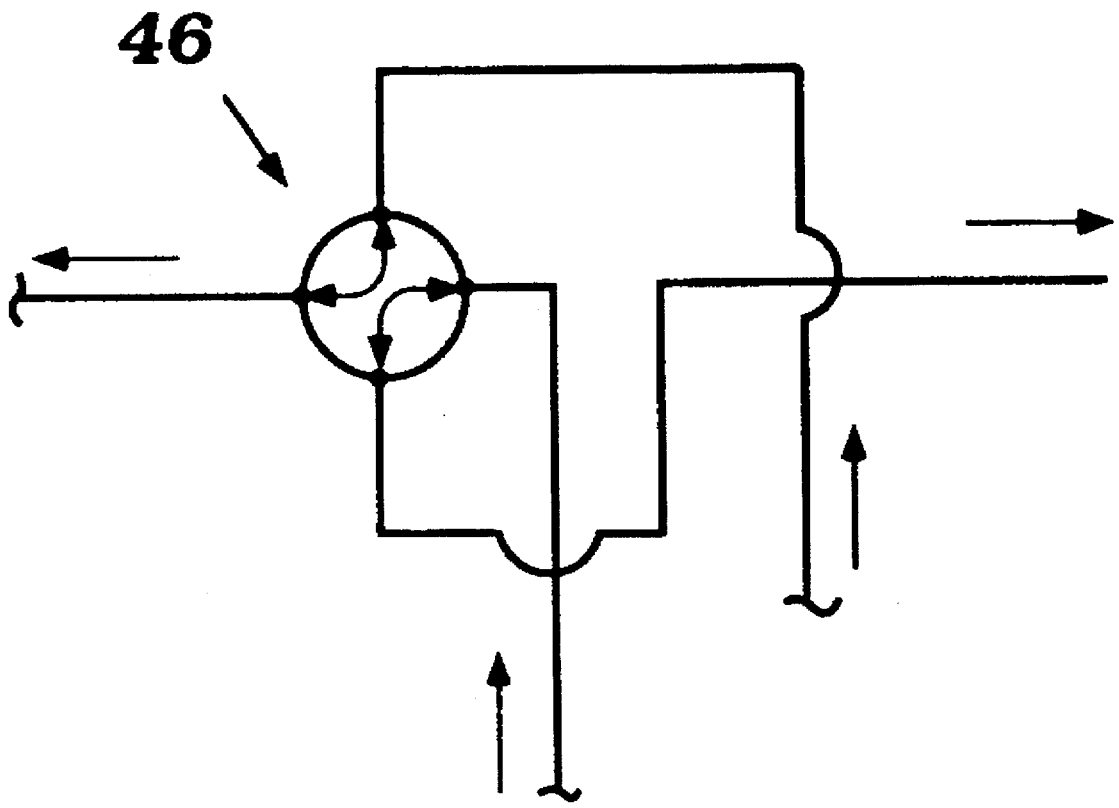
FIG. 11 is a schematic partial circuit around the four-way valve of the air-conditioning apparatus in the heating mode indicated in FIG. 10.
Figure 12:
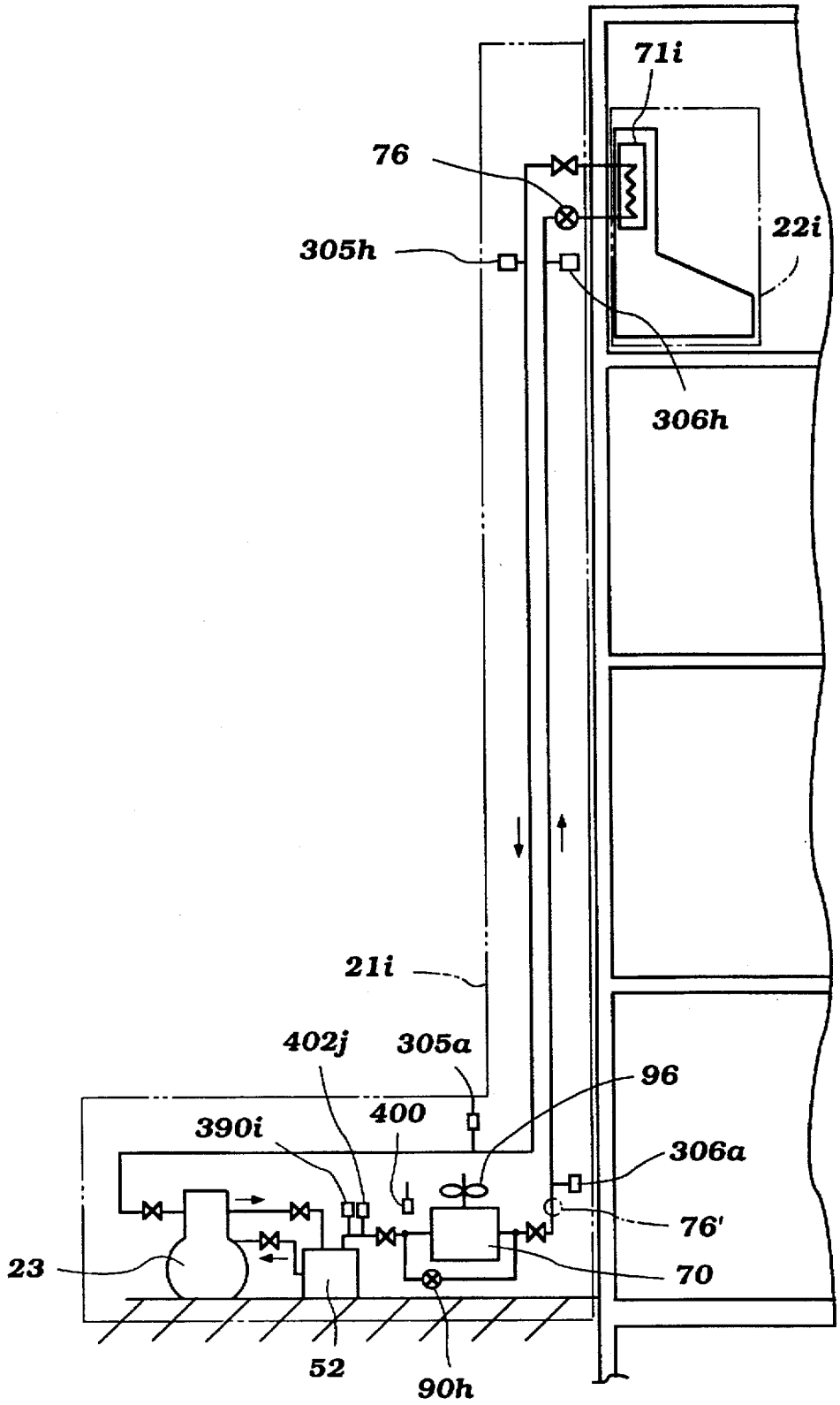
FIG. 12 is a schematic cross-sectional vertical view illustrating structures of a refrigeration apparatus according to the present invention, in which an inside unit is placed on the fourth floor.

FIG. 10 shows an air-conditioning apparatus in the cooling mode, a fifth embodiment of the present invention. FIG. 11 shows a circuit around a four-way valve in the heating mode of the fifth embodiment. FIG. 12 shows a refrigerator, a sixth embodiment of the present invention.

The air-conditioning apparatus in FIG. 10 is in the cooling mode, and has an inside unit including an evaporator placed on the fourth floor. When in the heating mode, the four-way valve is set as shown in FIG. 11. An outside unit 21*h* is placed on the ground while an inside unit 22*h* is placed on a floor higher than the second floor (the fourth floor in the figure), and an expansion valve 76 is located in the vicinity of the inside unit 22*h*. In this structure, because the level of the expansion valve 76 is higher than that of the outside unit 21*h*, in the cooling mode, the pressure of the refrigerant discharged from the compressor in the high pressure refrigerant line from the four-way valve 46 to the expansion valve 76 decreases at a position immediately upstream of the expansion valve 76 due to the head difference. Further, since the expansion valve 76 is located apart from the compressor 23, the pressure loss in piping occurs, resulting in further reduction in pressure immediately upstream of the expansion valve 76 in the high pressure refrigerant line. As a result, the difference between the upstream pressure and the downstream pressure of the expansion valve 76 becomes small, leading to a decrease in the amount of the refrigerant passing through the expansion valve 76, thereby reducing the cooling capacity of the inside unit 22*h*.

In the cooling mode, the amount of the refrigerant passing through the expansion valve 76 is determined in such a way that: (a) the greater the difference between the pressure measured by a pressure sensor 306*a* and the pressure measured by a pressure sensor 306*h*, which constitute high pressure sensing means; (b) the greater the difference between the pressure measured by the pressure sensor 306*h* and the pressure measured by a pressure sensor 305*h* constituting low pressure sensing means, wherein the pressure sensor 305*h* and 306*h* are provided in the vicinity of the expansion valve and substantially at the same altitude; or (c) the lower the pressure measured by the pressure sensor 305*h*, the smaller the amount of the refrigerant passing through the expansion valve 76 located at a high altitude becomes. In addition, by the above measurement, the decrease in the amount of the refrigerant passing through the expansion valve 76 due to pressure loss in lengthy piping in the refrigerant line from the outside heat-exchanger 70 functioning as a condenser through the expansion valve 76, can also be detected.

Further, the greater the difference between the pressures measured by the respective pressure sensors 305*h* and 305*a* constituting low pressure sensing means, the lower the discharge pressure of the compressor as well as the amount of the refrigerant discharging from the compressor become, resulting in an increase in the radiation area per refrigerant weight/time. When the amount of the condensed refrigerant increases, the pressure after passing through the condenser decreases. Thus, the decrease in the amount of the refrigerant passing through the expansion valve 76 is determined in such a way that the greater the difference between the pressures measured by the respective pressure sensors 305*h* and 305*a*, the greater the decrease in the amount becomes. That is, the decrease in the amount of the refrigerant passing through the expansion valve 76 due to pressure loss in lengthy piping in the refrigerant circulation line from the expansion valve 76 through the four-way valve 46 can be detected.

In the heating mode, the amount of the refrigerant passing through the expansion valve 76 is determined in such a way that: (a) the greater the difference between the pressure measured by the pressure sensor 305*a* and the pressure measured by the pressure sensor 305*h*, which constitute high pressure sensing means; (b) the greater the difference between the pressure measured by the pressure sensor 305*h* and the pressure measured by a pressure sensor 306*h* constituting low pressure sensing means, wherein the pressure sensor 305*h* and 306*h* are provided in the vicinity of the expansion valve and substantially at the same altitude; (c) the lower the pressure measured by the pressure sensor 305*h*; or (d) the greater the difference between the pressures measured by the respective pressure sensors 306*h* and 306*a* constituting low pressure sensing means, the smaller the amount of the refrigerant passing through the expansion valve 76 located at a high altitude becomes. When the amount of the refrigerant passing through the expansion valve 76 decreases, the cooling capacity in the cooling mode, or the heating capacity in the heating mode, decreases.

The temperature of the refrigerant in the cooling mode is measured by a temperature sensor 402*h*, and the temperature of the refrigerant in the heating mode is measured by a temperature sensor 402*i*.

FIG. 12 illustrates structures of a refrigeration apparatus, in which an inside unit is placed on the fourth floor, for example. An outside unit 21*i* is placed on the ground while a freezing unit 22*i* including an evaporator 71 is placed on a floor higher than the second floor (the fourth floor in the figure), and an expansion valve 76 is located in the vicinity of the freezing unit 22*i*. In this structure, when the freezing unit 22*i* is in the freezing mode in order to freeze material in the storage compartment, freezing operation is conducted in association with an increase in pressure loss in piping between the outside 21*i* unit and the freezing unit 22*i*. The difference between the pressures detected by respective pressure sensors 305*h* and 305*a* for sensing pressure in the low pressure refrigerant line, or the difference between the pressures detected by respective pressure sensors 306*a* and 306*h* for sensing pressure in the high pressure refrigerant line, shows increased pressure loss occurring in the piping and increased head difference between the freezing unit 22*i* and the outside unit 21*i*.

Refrigerant Flow Control System based on Heat Control

In the present invention, as one embodiment of the energy-supplying mechanism for exerting energy onto the refrigerant, as shown in FIG. 2, the accumulator 58 is installed between the evaporator, i.e., the inside heat-exchangers 71, and the compressors A and B. In the accumulator 58, the hot water heat-exchanger 88 is provided to exert heat onto the refrigerant by utilizing exhaust heat from the engine.

As another embodiment of the energy-supplying mechanism for exerting energy onto the refrigerant, electrical heat is provided. As shown in FIG. 2, the heater 53, the heater 59, and the heater 65 are provided in the oil separator 52, the accumulator 58, and the subaccumulator 56, respectively.

As another embodiment of the energy-supplying mechanism for exerting energy onto the refrigerant, a heat-exchanging unit is provided to exchange heat between the refrigerant and the water-cooled engine 23 or the compressors A and B. As shown in FIGS. 4–8, the heat-exchanging mechanism is employed in the oil reservoir 119 for accommodating lubricating oil, i.e., the oil reservoir 119 and the subaccumulator 56 are adjoined with the heat-exchanging wall 100*c* interposed therebetween. Frictional heat, which increases in accordance with an increase in the rpm's of the compressors A and B, can be exerted onto the refrigerant.

In the above, stabilization of heat pumping operation by controlling the refrigerant flow passing through the expansion valve can be achieved in such a way that the lower the refrigerant flow passing through the expansion valve, i.e., the lower the outside temperature when in the cooling mode, the higher the volume of hot water becomes, the higher the intensity of electric current passing through the heater becomes, or the higher the rpm's of the engine becomes. The radiation heat capacity is the capacity of the condenser, i.e., the outside heat-exchanger 70 when in the cooling mode, and the endothermic heat capacity is the capacity of the evaporator, i.e., the inside heat-exchangers 71 when in the cooling mode.

Figure 13:
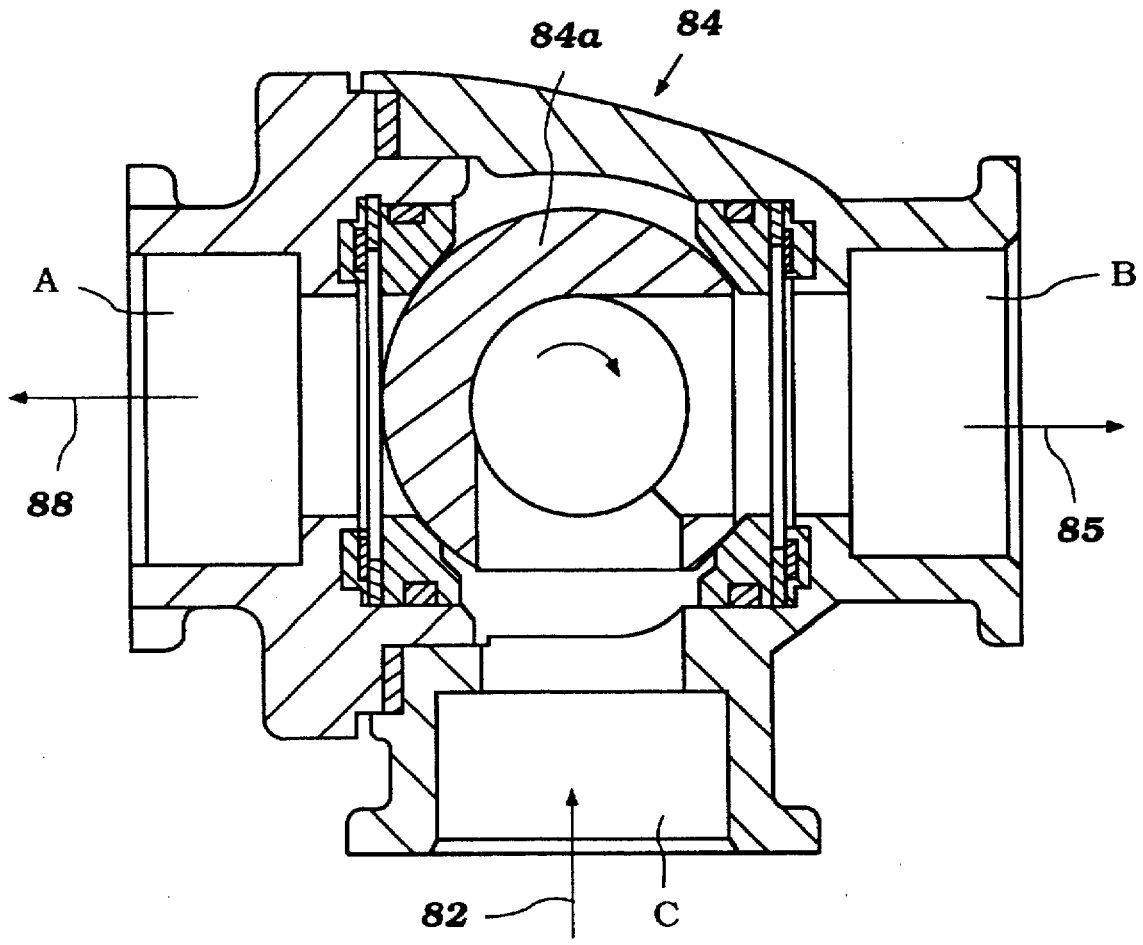
FIG. 13 is a schematic cross-sectional view illustrating structures of a three-way valve usable in the present invention, in which ports B and C are communicated.
Figure 14:
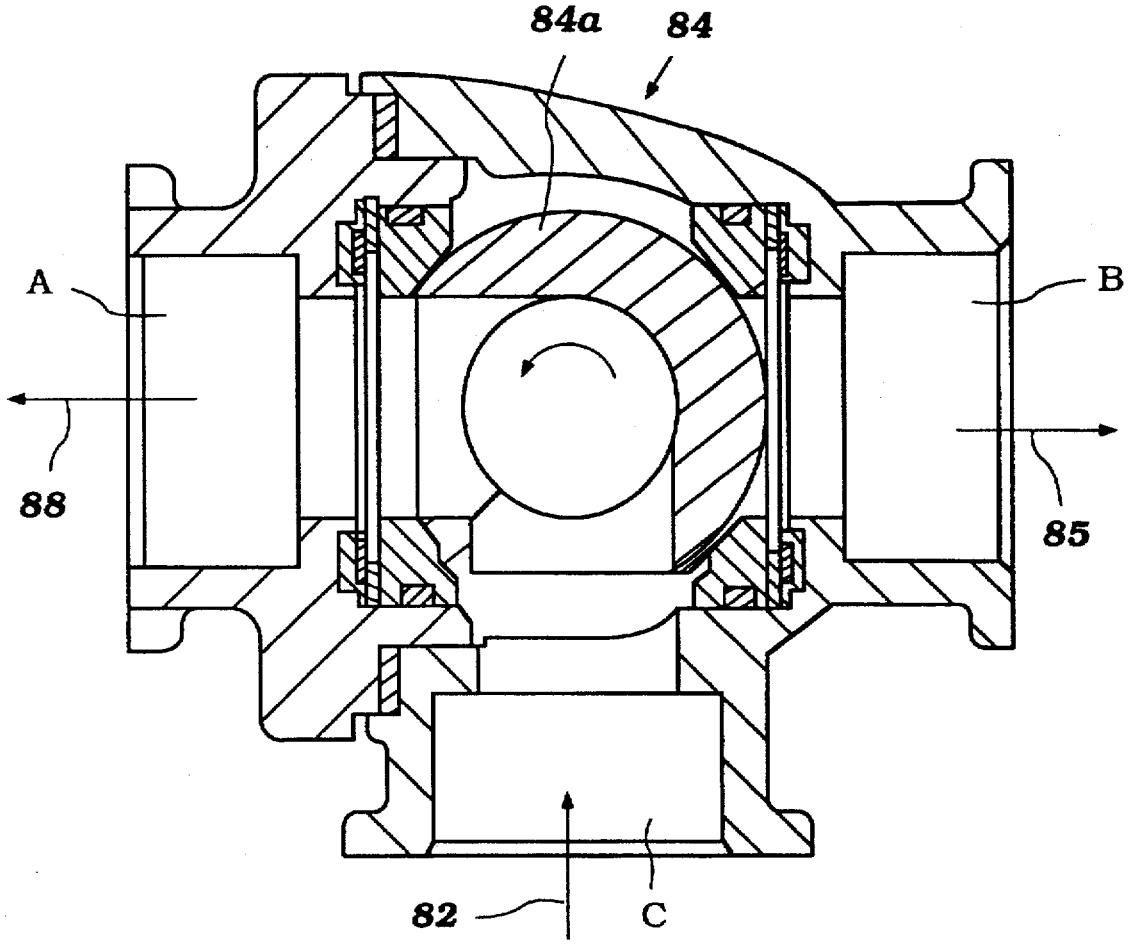
FIG. 14 is a schematic cross-sectional view illustrating structures of the three-way valve of FIG. 13, in which ports A and C are communicated.
Figure 15:
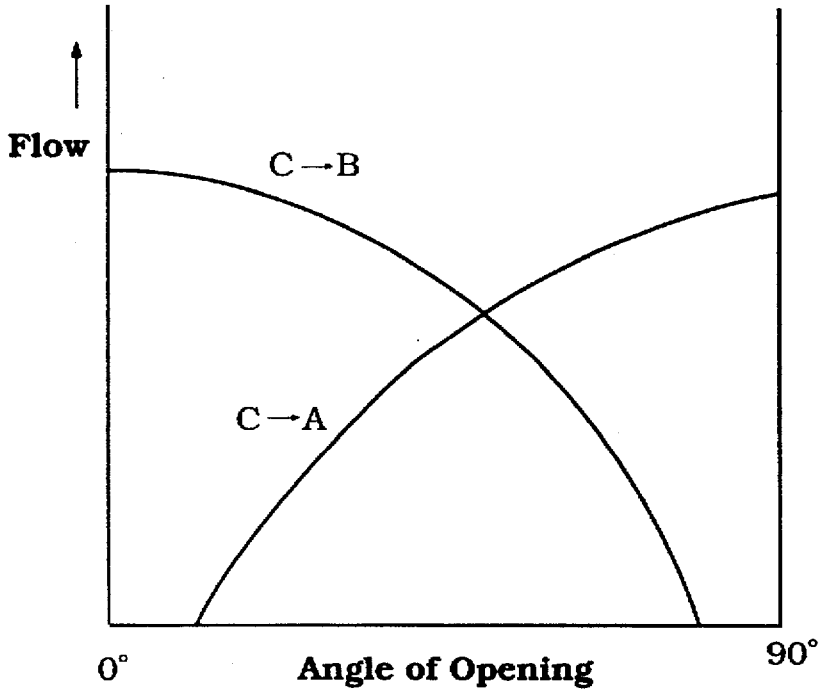
FIG. 15 is a schematic graph showing the relationship between the flow and the opening angle of valves of a three-way valve usable in the present invention.

For example, as shown in FIGS. 13 and 14, when the three-way valve 84 provided in the hot water circulation line 5 is a linearly controlled valve, a port A is communicated to the line connecting to the hot water heat-exchanger 88 in the accumulator 58, a port B is communicated to the line connecting to the radiator 85 of the outside unit 21, and a port C is communicated to the line connecting to the heat-exchanger 82 of the water-cooled engine 23. The opening of each port is controlled by rotating a rotary valve shaft 84*a*, thereby controlling the volume and the route of hot water flow (FIG. 15).

When in the cooling mode, the lower the refrigerant flow passing through the expansion valve, the more the rotary valve shaft 84*a* is rotated in such a way as to increase the flow of hot water from the port C to the port A, thereby exerting heat onto the refrigerant in the refrigerant circulation line on the low pressure side, i.e., the line from the expansion valve 76 to the compressors A and B via the outside heat-exchanger 70 functioning as a condenser.

As described above, by (1) exerting heat onto the refrigerant; (2) increasing the rpm's of the compressors A and B; (3) increasing the number of engaged compressors, i.e., both compressors A and B are engaged; (4) discontinuing operation of a cooling fan motor 96 at the outside unit 21, in such a way as to increase the difference in pressure between the high pressure side and the low pressure side, it is possible to compensate for insufficient endothermic heat capacity.

Refrigerant Flow Sensing System

As one embodiment of a sensing means for sensing the refrigerant flow passing through the expansion valve, as shown in FIG. 2, the pressure sensor 390 for sensing high pressure is provided in the refrigerant circulation line on the high pressure side between the compressors A and B and the expansion valve 76. Further, as shown in FIG. 9, the pressure sensor 305 for sensing high pressure is provided in the high pressure refrigerant line (when in the cooling mode) near the expansion valve 76 and between the compressors A and B and the expansion valve 76. The pressure detected by the pressure sensor 390 or 305 for high pressure can be determined in such a way that the lower the detected pressure, the lower the refrigerant flow passing through the expansion valve 76 has become.

Further, as shown in FIG. 9, when the pressure sensor 305 for sensing high pressure (when in the cooling mode) is provided in the line upstream of the expansion valve 76, and the pressure sensor 306 for sensing low pressure (when in the cooling mode) is provided in the line downstream of the expansion valve 76, the difference between the pressure detected by the pressure sensor 305 for high pressure and that detected by the pressure sensor 306 for low pressure can be determined in such a way that the smaller the difference between the high pressure and the low pressure, the lower the refrigerant flow passing through the expansion valve 76 has become. In the above, when in the heating mode, in place of the pressure sensor 305, the pressure sensor 306 is used for measuring the pressure in the high pressure refrigerant line.

In the embodiment shown in FIG. 2, a temperature sensor 400 is provided to detect the outside temperature. The temperature detected by the temperature sensor 400 can be determined in such a way that the lower the detected temperature, the lower the refrigerant flow passing through the expansion valve 76 has become.

In the embodiment shown in FIG. 2, a temperature sensor 402 for sensing the temperature of the refrigerant upstream of the condenser (inside heat-exchanger 70), in addition to the temperature sensor 400 are provided. The difference between the temperature detected by the temperature sensor 402 and the temperature detected by the temperature sensor 400 can be determined in such a way that the higher the difference in the detected temperature, the lower the refrigerant flow passing through the expansion valve 76 has become. In addition, as shown in FIG. 10, the temperature sensor **402*a* for sensing the refrigerant immediately upstream of the outside heat-exchanger 70 or the temperature sensor 402*c* for sensing the refrigerant passing through the outside heat-exchanger 70 can be provided, and the difference between the temperature detected by the temperature sensor 402*a* or 402*c* and the temperature detected by the temperature sensor 400 can be determined in such a way that the higher the difference in the detected temperature, the lower the refrigerant flow passing through the expansion valve 76 has become. Referential numeral 402*b* is a temperature sensor for sensing the temperature of the refrigerant immediately upstream of the outside unit in the heating mode, i.e., the outside heat-exchanger 70**.

In the embodiment shown in FIG. 2, a pressure sensor 401 is provided to detect the pressure in the low refrigerant line near the compressors A and B. The low pressure detected by the pressure sensor 401 can be determined in such a way that the higher the detected pressure near the compressors, the lower the refrigerant flow passing through the expansion valve 76 has become.

Further, as shown in FIG. 2, when the temperature sensor 400 for sensing the outside temperature and the pressure sensor 401 for sensing the pressure in the refrigerant circulation line on the low pressure side are provided, the lower the inside temperature the higher the target low pressure is selected. The low pressure detected by the pressure sensor 401 can be determined in such a way that the higher the difference between the detected pressure near the compressor A and B and the target pressure, the lower the refrigerant flow passing through the expansion valve 76 has become.

As shown in FIGS. 2 and 9, when the temperature sensor 400 for sensing the outside temperature and the pressure sensor 305 for sensing the pressure in the refrigerant circulation line on the high pressure side, i.e., the line from the compressors A and B to the expansion valve 76 via the outside heat-exchanger 70 (condenser) are provided, the higher the outside temperature, the higher the target high pressure is selected, wherein the target high pressure is higher than the detected pressures. The high pressure detected by the pressure sensor 305 can be determined in such a way that the greater the difference between the detected pressure and the target pressure, the lower the refrigerant flow passing through the expansion valve 76 has become.

In FIG. 10, the pressure loss in piping can be determined in such a way that the greater the difference between the pressures detected by respective pressure sensors **305*h* and 305*a* for sensing pressure in the refrigerant circulation line on the low pressure side, or the greater the difference between the pressures detected by respective pressure sensors 306*a* and 306*h* for sensing pressure in the refrigerant circulation line on the high pressure side, the lower the refrigerant flow passing through the expansion valve 76 installed on a high level becomes. The pressure downstream of the compressor 23 and upstream of the condenser 70 is measured by the pressure sensor 390*h*, and the temperature of the refrigerant downstream of the compressor 23 and upstream of the condenser 70 is measured by the temperature sensor 402*h*. In a similar way, in FIG. 12, the pressure loss in piping can be determined in such a way that the greater the difference between the pressures detected by respective pressure sensors 305*h* and 305*a* for sensing pressure in the refrigerant circulation line on the low pressure side, or the greater the difference between the pressures detected by respective pressure sensors 306*a* and 306*h* for sensing pressure in the refrigerant circulation line on the high pressure side, the lower the refrigerant flow passing through the expansion valve 76 installed on a high level becomes. The pressure downstream of the compressor 23 and upstream of the condenser 70 is measured by the pressure sensor 390*i*, and the temperature of the refrigerant downstream of the compressor 23 and upstream of the condenser 70 is measured by the temperature sensor 402*j***.

When the expansion valve 76 is provided at the position 76' in FIGS. 10 and 12, i.e., the pressure sensor **306*a* is provided downstream of the expansion valve 76, the pressure loss in piping can be determined in such a way that the greater the difference between the pressures detected by the pressure sensors 306*a* and either 306*h* or 305*a* for sensing pressure in the refrigerant circulation line on the low pressure side, the lower the refrigerant flow passing through the expansion valve 76** installed on a high level becomes.

Figure 18:
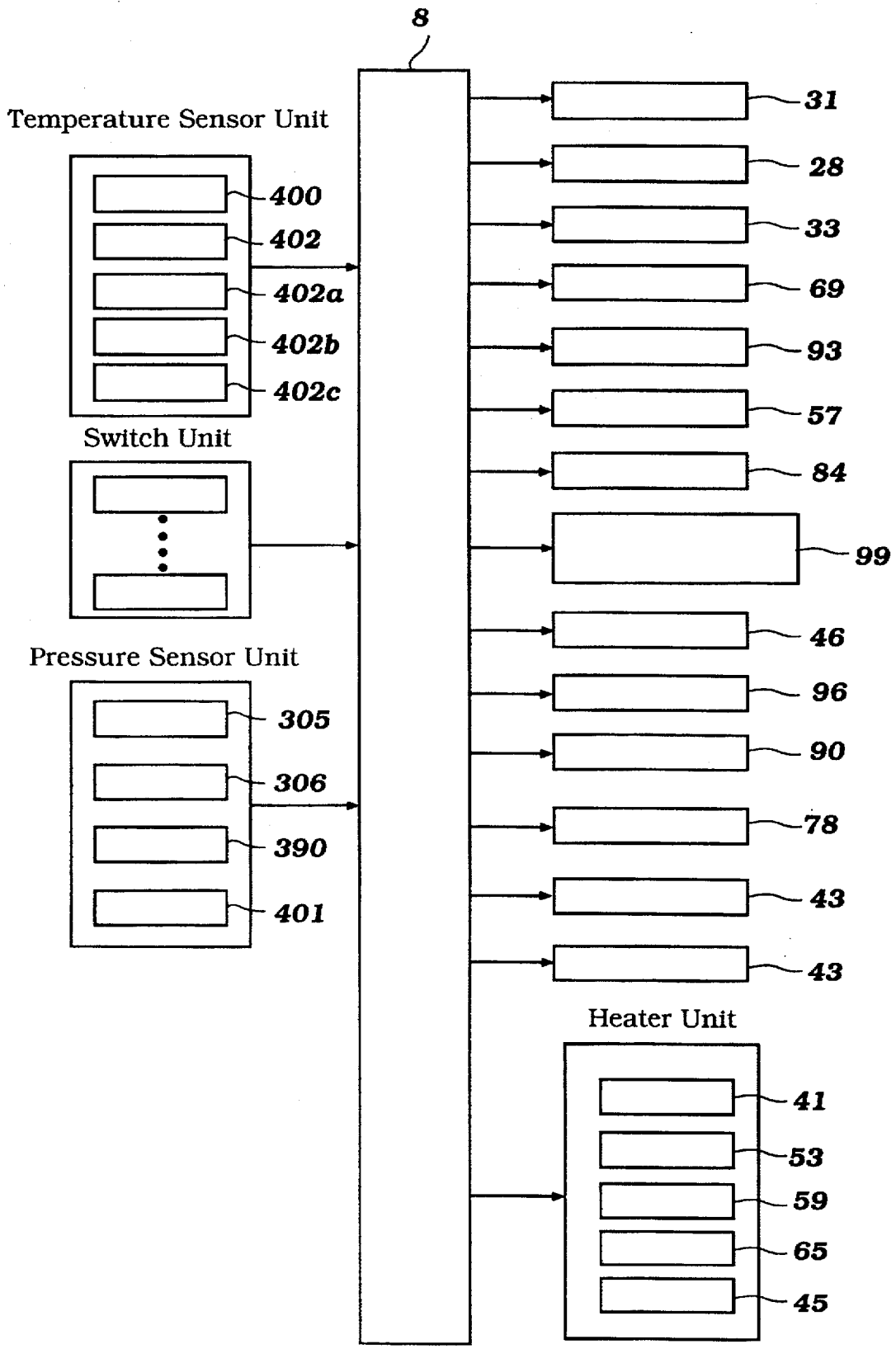
FIG. 18 is a schematic block chart showing a control system of an embodiment of the present invention, comprising a switch group, a temperature sensor group, a pressure sensor group, a control group, a heater group, and an actuator group.

FIG. 18 is a schematic block chart showing the sensing system group, the control system unit, and the output system group.

In the present invention, each flow control mechanism described above can be employed singly or in combination of two or more to achieve the objective of the present invention, i.e., controlling refrigerant flow through the expansion valve.

Further, this invention can be adapted to control of refrigerant flow when in the heating mode, e.g., when the outside temperature is very cold. In the heating mode, the inside heat-exchanger functions as a condenser, and the outside heat-exchanger functions as an evaporator.

Operation of Refrigerant Flow Control

As described above, a heat pump system of the present invention is provided with a refrigerant flow control system which allows for stable cooling, freezing, or heating operation by controlling the pressure in the high pressure refrigerant line, especially when the head difference between the compressor and the expansion valve which are located at different altitudes is great, and when the pressure loss in piping is great, and further when evaporation capacity decreases due to, for example, a cold or windy environment. The above goal can be achieved by fulfilling at least one of the operations h–j described below corresponding to the following target conditions A–I:

A. When a pressure sensing means for sensing high pressure is provided in the high pressure line near the expansion valve, control is conducted in such a way that the lower the detected pressure than a given value, the higher the pressure becomes.

B. When a pressure sensing means for sensing low pressure is provided in the low pressure line near the expansion valve, control is conducted in such a way that the lower the detected pressure than a given value, the higher the pressure becomes.

C. When a pressure sensing means is provided upstream of the expansion valve on the high pressure side, and a pressure sensing means is provided downstream of the expansion valve on the low pressure side, control is conducted in such a way that the smaller the difference between the detected pressures, the greater the difference becomes.

D. When a temperature sensing means for detecting the outside temperature and a pressure sensing means for detecting the pressure in the refrigerant circulation line on the low pressure side, i.e., the line from the expansion valve to the compressor via the evaporator, are provided, the lower the detected temperature, the higher the target low pressure is selected, and control is conducted in such a way that the higher the difference between the target pressure and the detected pressure, the lower the difference in pressure becomes.

E. When a temperature sensing means for detecting the outside temperature and a pressure sensing means for detecting the pressure in the refrigerant circulation line on the high pressure side, i.e., the line from the compressor to the expansion valve via the condenser, are provided, the lower the detected temperature, the higher the target high pressure is selected, and control is conducted in such a way that the higher the difference between the target pressure and the detected pressure, the lower the difference in pressure becomes.

H. (1) When a pressure sensing means is provided at two positions apart from each other in the line on the high pressure side, control is conducted in such a way that the greater the difference between the pressure measured by the pressure sensing means positioned farther from the expansion valve than is the other sensing means and the pressure measured by the other sensing means positioned closer to the expansion valve than the former, the smaller the difference becomes; or (2) when a pressure sensing means is provided at two positions apart from each other in the line on the low pressure side, control is conducted in such a way that the greater the difference between the pressures measured by the respective pressure sensing means, the greater the difference becomes.

I. One or more of the above A–H are combined.

Figure 16:
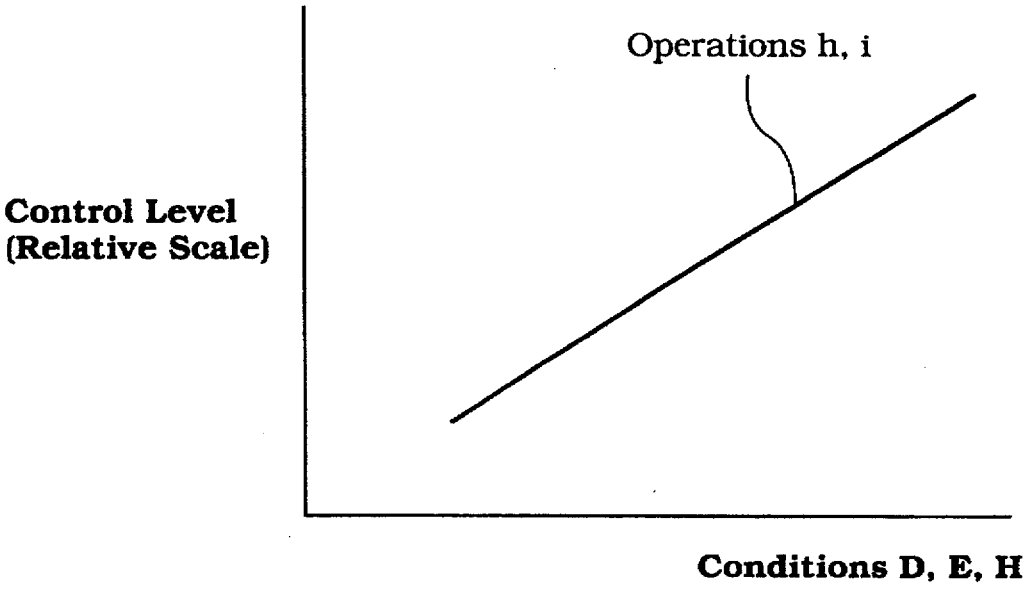
FIG. 16 is a schematic graph showing the conceptual relationship between the degree of control factors h-i and the degree of conditions D, E, and H in an embodiment of the present invention.
Figure 17:
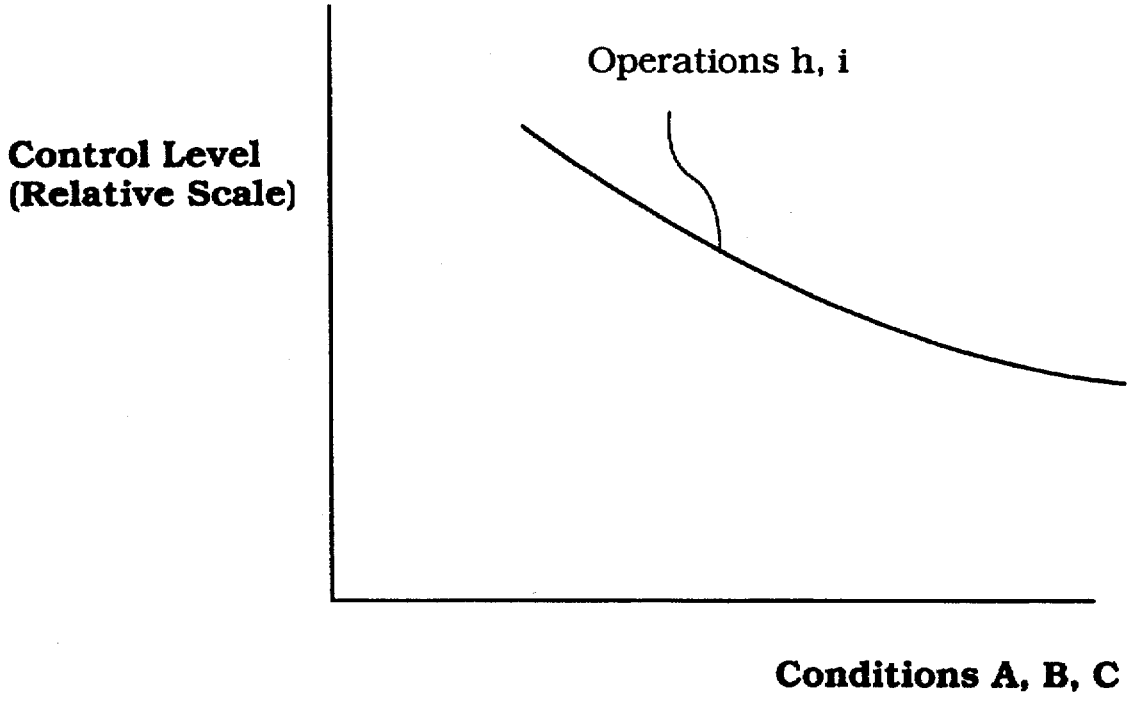
FIG. 17 is a schematic graph showing the conceptual relationship between the degree of control factors h-i and the degree of conditions A, B, and C in an embodiment of the present invention.

Operations to satisfy the above target conditions are as follows, and control can be achieved as shown in FIGS. 16 and 17:

h. Heat exerted onto the refrigerant on the low pressure side is increased.

i. Heat exerted onto the refrigerant on the high pressure side is increased.

j. Control is conducted by a combination of h–i.

It will be understood by those of skill in the art that numerous variations and modifications can be made without departing from the spirit of the present invention. Therefore, it should be clearly understood that the forms of the present invention are illustrative only and are not intended to limit the scope of the present invention.

We claim:

1. A heat pump system comprising a refrigerant circulation line in which a refrigerant circulates, said refrigerant circulation line comprising: a compressor for circulating said refrigerant; a condenser for exchanging heat between said refrigerant and the medium outside said condenser; an expansion valve; and an evaporator for exchanging heat between said refrigerant and the medium outside said evaporator, wherein the refrigerant circulation line downstream of said compressor and upstream of said expansion valve constitutes a high pressure refrigerant line, and the refrigerant circulation line downstream of said expansion valve and upstream of said compressor constitutes a low pressure refrigerant line, said system further comprising: a high pressure sensing means for measuring the pressure in the high pressure refrigerant line, said high pressure sensing means being provided at a location closer to said expansion valve than to said compressor; a low pressure sensing means for measuring the pressure in the low pressure refrigerant line; and an energy-supplying mechanism for exerting energy onto the refrigerant when the difference between the pressure measured by said high pressure sensing means and that measured by said low pressure sensing means is smaller than a predetermined value.

2. A heat pump system according to claim 1, wherein said energy-supplying mechanism is provided in the low pressure refrigerant line.

3. A heat pump system according to claim 2, further comprising an accumulator for accumulating a liquid refrigerant provided in the low pressure refrigerant line, said accumulator comprising refrigerant-heating means for heating the liquid refrigerant in said accumulator, wherein said energy-supplying mechanism is said refrigerant-heating means.

4. A heat pump system according to claim 1, further comprising a four-way valve for reversing the flow of said refrigerant at said condenser and at said evaporator to switch the operation mode between the heating mode and the cooling mode, said four-way valve being provided downstream of said compressor, wherein said condenser is an inside heat-exchanger when in the heating mode and is an outside heat-exchanger when in the cooling mode, and said evaporator is said inside heat-exchanger when in the cooling mode and is said outside heat-exchanger when in the heating mode, wherein said energy-supplying mechanism is provided either in the high pressure refrigerant line between said compressor and said four-way valve or in the low pressure refrigerant line between said four-way valve and said compressor.

5. A heat pump system according to claim 4, further comprising an accumulator for accumulating a liquid refrigerant provided in the low pressure refrigerant line between said four-way valve and said compressor, said accumulator comprising refrigerant-heating means for heating the liquid refrigerant in said accumulator, wherein said energy-supplying mechanism is said refrigerant-heating means.

6. A heat pump system according to claim 4, further comprising: a water-cooled engine for driving said compressor; and a cooling water heat-exchanger for exchanging heat between the cooling water circulating therethrough, which has absorbed heat from said water-cooled engine, and the refrigerant circulating therethrough, wherein said energy-supplying mechanism is said cooling water heat-exchanger.

* * * * *